US009618884B2

(12) United States Patent
Nishizawa et al.

(10) Patent No.: US 9,618,884 B2
(45) Date of Patent: Apr. 11, 2017

(54) IMAGE HEATING APPARATUS

(71) Applicant: CANON KABUSHIKI KAISHA, Tokyo (JP)

(72) Inventors: Yuki Nishizawa, Yokohama (JP); Hiroshi Mano, Numazu (JP); Minoru Hayasaki, Mishima (JP); Aoji Isono, Naka-gun (JP); Yosuke Kitagawa, Yokohama (JP); Katsuhisa Matsunaka, Inagi (JP); Kimitaka Ichinose, Mishima (JP); Michio Uchida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/571,855

(22) Filed: Dec. 16, 2014

(65) Prior Publication Data

US 2015/0168895 A1 Jun. 18, 2015

(30) Foreign Application Priority Data

Dec. 18, 2013 (JP) ..... 2013-261520

(51) Int. Cl.
*G03G 15/20* (2006.01)

(52) U.S. Cl.
CPC ..... *G03G 15/2053* (2013.01); *G03G 15/2064* (2013.01); *G03G 2215/2035* (2013.01)

(58) Field of Classification Search
CPC ..... G03G 15/2053; G03G 15/2017
See application file for complete search history.

(56) References Cited

U.S. PATENT DOCUMENTS 6,070,046 A * 5/2000 Maeyama ..... H05B 6/145 399/328

FOREIGN PATENT DOCUMENTS

| | | | | |
|---|---|---|---|---|
| JP | 10-123861 | A | | 5/1998 |
| JP | 10-319748 | A | | 12/1998 |
| JP | 2000029332 | A | * | 1/2000 |
| JP | 2000-35724 | A | | 2/2000 |
| JP | 2000-39796 | A | | 2/2000 |
| JP | 2001-125407 | A | | 5/2001 |
| JP | 2003229239 | A | * | 8/2003 |
| JP | 2004-79824 | A | | 3/2004 |
| JP | 2004-288437 | A | | 10/2004 |
| JP | 2014-26267 | A | | 2/2014 |

OTHER PUBLICATIONS

Ishimaru et al. (JP 2000-029332 A), Jan. 2000, JPO Computer Translation.*

* cited by examiner

*Primary Examiner* — Erika J Villaluna
(74) *Attorney, Agent, or Firm* — Canon USA, Inc. IP Division

(57) ABSTRACT

An image heating apparatus configured to heat an image formed on a recording material includes a cylindrical rotatable member including a conductive layer, a magnetic core inserted through the rotatable member, a coil helically wound around an outer side of the magnetic core within the rotatable member, and an inverter configured to supply an alternating current to the coil. A frequency of the alternating current supplied from the inverter is within a range of 20.5 to 100 kHz. The conductive layer generates heat by electromagnetic induction due to an alternating magnetic field produced from the alternating current supplied to the coil. The coil is wound at an interval of 1 mm or longer.

4 Claims, 23 Drawing Sheets

$$P_{SLV} = \frac{V^2_{SLV}}{R_{SLV}}$$

FIG.15A

LONGITUDINAL CONFIGURATION OF IMAGE HEATING APPARATUS

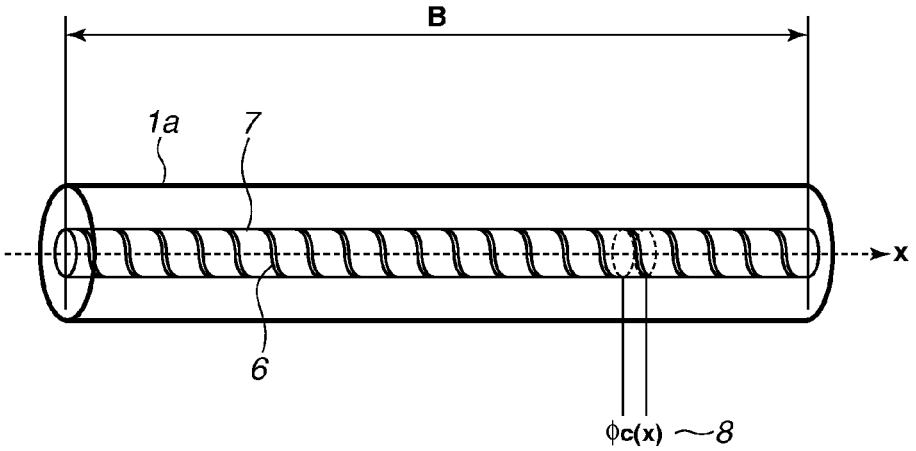

FIG.15B

ENLARGED VIEW OF REGION PER UNIT LENGTH

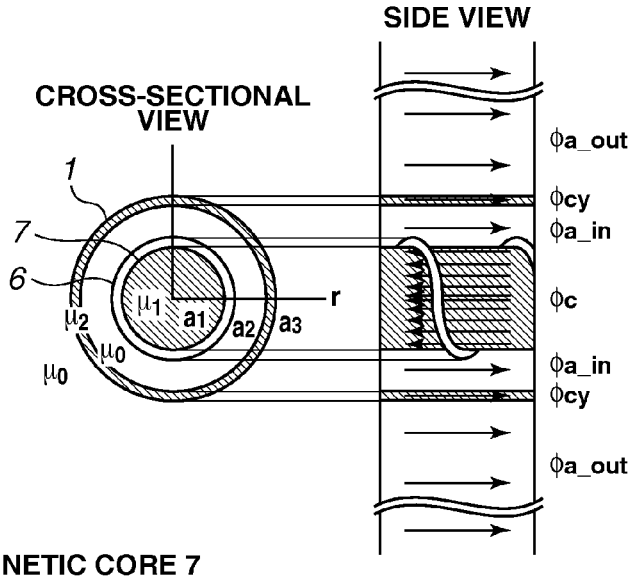

$a_1$: RADIUS OF MAGNETIC CORE 7
$a_2$: INNER DIAMETER OF HOLLOW CYLINDRICAL MEMBER 1
$a_3$: OUTER DIAMETER OF HOLLOW CYLINDRICAL MEMBER 1
$\mu_0$: MAGNETIC PERMEABILITY IN AIR
$\mu_1$: MAGNETIC PERMEABILITY IN MAGNETIC CORE 7
$\mu_2$: MAGNETIC PERMEABILITY IN HOLLOW CYLINDRICAL MEMBER 1

$$P_c \cdot V_m = \phi_c = \phi_{a_in} + \phi_s + \phi_{a_out}$$
$$= P_{a_in} \cdot V_m + P_s \cdot V_m + P_{a_out} \cdot V_m$$
$$= (P_{a_in} + P_s + P_{a_out}) \cdot V_m$$
$$\therefore P_c - P_{a_in} - P_s - P_{a_out} = 0$$

$$P_c = \mu_1 \cdot S_1$$
$$P_{a_in} = \mu_0 \cdot (S_2 - S_1)$$
$$P_{cy} = \mu_2 \cdot (S_3 - S_2)$$
$$P_{a_out} = P_c - P_{a_in} - P_{cy}$$

CONVERT HIGH-FREQUENCY CURRENT OF EXCITING COIL TO LOOP CURRENT AROUND SLEEVE

EQUIVALENT CIRCUIT OF EXCITING COIL AND SLEEVE

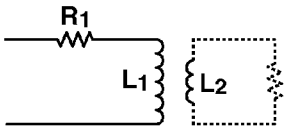

$R_1 + j\omega L_1$ $R_1$ CORRESPONDS TO LOSS DUE TO COIL.
$R_2$ IS RESISTANCE VALUE OF SLEEVE.

FIG.19A

EQUIVALENT CIRCUIT WHEN SLEEVE IS NOT MOUNTED

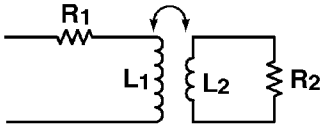

FIG.19B

EQUIVALENT CIRCUIT WHEN SLEEVE IS MOUNTED

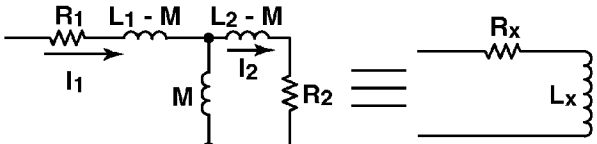

$R_x + j\omega L_x$

LEFT-SIDE CIRCUIT IS CONVERTED INTO EQUIVALENT CIRCUIT THAT IS RIGHT-SIDE CIRCUIT.

$R_x$ IS REAL PART OF VALUE MEASURED BY IMPEDANCE ANALYZER WHEN SLEEVE IS MOUNTED (CORRESPONDING TO RESISTANCE).

$L_x$ IS IMAGINARY PART (CORRESPONDING TO INDUCTANCE).

FIG.19C

EQUIVALENTLY CONVERTED INTO T-TYPE

CROSS-SECTIONAL VIEW OF REGION 1 OR 3

CROSS-SECTIONAL VIEW OF REGION 2

IMAGE HEATING APPARATUS

BACKGROUND

Field of the Invention

The present disclosure relates to an image heating apparatus included in an image forming apparatus such as a copying machine and a printer, and, in particular, to an apparatus configured to heat an image by electromagnetic induction heating with use of a high frequency.

Description of the Related Art

Conventionally, there is provided an image forming apparatus such as a copying machine and a printer of the electrophotographic method or the like that includes an image heating apparatus configured to heat and fix an unfixed image (a toner image) formed on a recording material such as printing paper and an overhead projector (OHP) sheet by an appropriate image formation process, onto a surface of the recording material as a permanently fixed image. One of methods employed for the image heating apparatus is the electromagnetic induction heating method. This type of image heating apparatus includes a heated member configured to generate heat by an induced current and an exciting coil configured to produce a magnetic flux, and heats the unfixed image on the recording material with the aid of the heat of the heated member. As such a fixing apparatus, there is discussed a fixing apparatus in which a part of a core configured to form a closed magnetic path is inserted through a hollow portion of a roller-like heated member, and an alternating current of a low frequency (50 to 60 Hz) is supplied to an exciting coil helically wound around the core so that the roller-like heated member is heated (see Japanese Patent Application Laid-Open No. 10-319748).

Generally, a transformer can be downsized by an increase in a driving frequency with use of a switching power source or the like. The reason therefor is that the increase in the driving frequency can reduce a magnetic flux required to produce a same voltage, thereby allowing a magnetic core to be designed so as to have a small cross-sectional area.

However, in the fixing apparatus discussed in Japanese Patent Application Laid-Open No. 10-319748, the increase in the driving frequency raises the following problem. Relatively high power of several hundred watts or higher should be produced in the image heating apparatus included in the image forming apparatus. Therefore, the exciting coil has a large number of turns, and a parasitic capacitance (also referred to as a stray capacitance or a floating capacitance) tends to be formed between adjacent coil wires. This parasitic capacitance behaves as if a capacitor is connected in parallel with the exciting coil. As a result, if an alternating current of a high frequency (a frequency range from 20.5 kHz to 100 kHz) is supplied to the exciting coil with use of a switching power source using a resonance circuit, a switching loss and a switching noise may increase according to an undesired charge to and discharge from the parasitic capacitance, resulting in breakage of the power source.

SUMMARY

Disclosed is an image heating apparatus, which is configured to heat an image formed on a recording material, includes a cylindrical rotatable member including a conductive layer, a magnetic core inserted through the rotatable member, a coil helically wound around an outer side of the magnetic core within the rotatable member, and an inverter configured to supply an alternating current to the coil. A frequency of the alternating current supplied from the inverter is within a range of 20.5 to 100 kHz. The conductive layer generates heat by electromagnetic induction due to an alternating magnetic field produced from the alternating current supplied to the coil. The coil is wound at an interval of 1 mm or longer.

Also disclosed is an image heating apparatus, which is configured to heat an image formed on a recording material, includes a cylindrical rotatable member including a conductive layer, a magnetic core inserted through the rotatable member, a coil helically wound around an outer side of the magnetic core within the rotatable member, and an inverter configured to supply an alternating current to the coil. A frequency of the alternating current supplied from the inverter is within a range of 20.5 to 100 kHz. The conductive layer generates heat by electromagnetic induction due to an alternating magnetic field produced from the alternating current supplied to the coil. A resistance $R_{SLV}$ of the conductive layer in a circumferential direction thereof is expressed by an expression (1), assuming that $L_{SLV}$ [m] represents a length of the conductive layer in a generatrix direction of the rotatable member, $d_{SLV}$ [m] represents a diameter, $t_{SLV}$ [m] represents a thickness, and $\rho_{SLV}$ [Ωm] represents a volume resistivity. An expression (2) is satisfied, assuming that $t_{COIL}$ represents a width of a wire of the coil, $L_{COIL}$ represents a length of a portion where the coil and the magnetic core overlaps each other in the generatrix direction, $V_e$ represents an effective value voltage of a commercial power source, which is supplied to the inverter, and $P_{SLV}$ represents power generated on the conductive layer.

$$R_{SLV} = \frac{\rho_{SLV} \times \pi d_{SLV}}{t_{SLV} \times L_{SLV}} \tag{1}$$

$$1 \leq \frac{\sqrt{2}\, V_e}{\pi \sqrt{P_{SLV} R_{SLV}}} \leq \frac{L_{COIL}}{1.0 + t_{COIL}} \tag{2}$$

Further features of the present invention will become apparent from the following description of exemplary embodiments with reference to the attached drawings.

BRIEF DESCRIPTION OF THE DRAWINGS

FIGS. 15A and 15B illustrate a method for calculating a magnetic permeance.

FIGS. 19A, 19B, and 19C illustrate power conversion efficiency.

DESCRIPTION OF THE EMBODIMENTS

Figure 1:
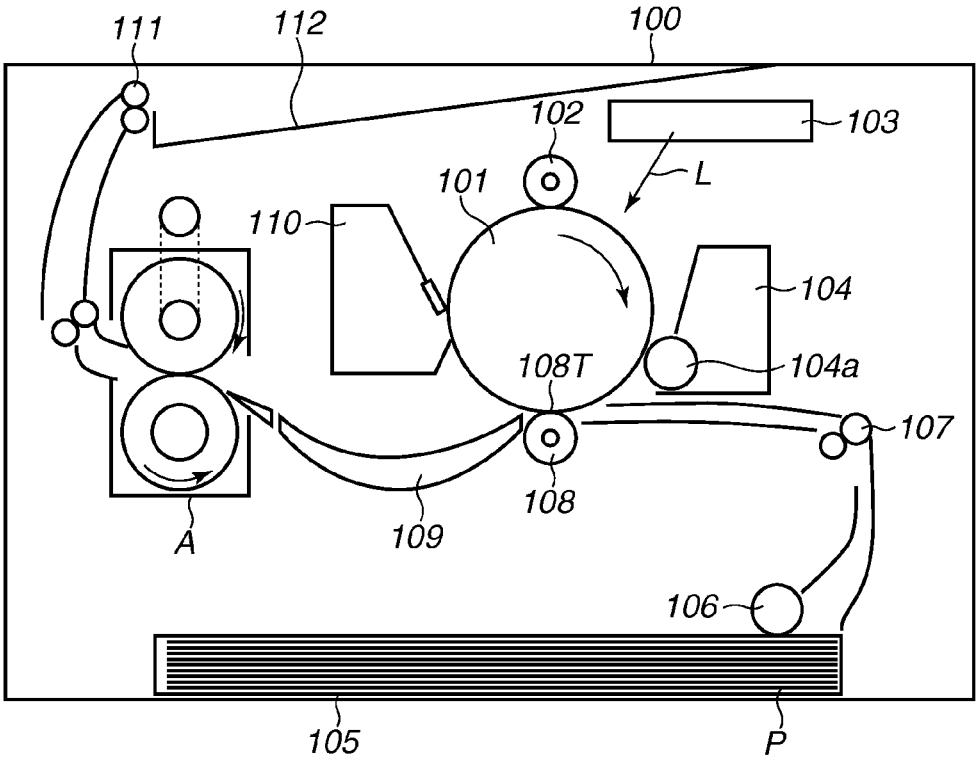
FIG. 1 illustrates an overview of a configuration of an image forming apparatus in which a heating apparatus is included.

1-1. General Description of Image Forming Apparatus Including Image Heating Apparatus FIG. 1 illustrates an overview of a configuration of an image forming apparatus 100 in which an image heating apparatus according to a first exemplary embodiment is included. The image forming apparatus 100 is an electrophotographic laser beam printer. A photosensitive drum 101 works as an image bearing member, and is rotationally driven at a predetermined process speed (a circumferential speed) in the clockwise direction indicated by an arrow. The photosensitive drum 101 is evenly charged so as to have a predetermined polarity and a predetermined electric potential by a charging roller 102 during this rotation process. A laser beam scanner 103 works as an image exposure unit. The scanner 103 outputs laser light L on-off keyed according to a digital image signal input from a not-illustrated external apparatus such as a computer and generated by an image processing unit, to scan and expose a charged surface of the photosensitive drum 101. Electric charges are removed from an exposed bright portion on the surface of the photosensitive drum 101 by this scanning and exposure, whereby an electrostatic latent image corresponding to the image signal is formed on the surface of the photosensitive drum 101. A development device 104 supplies a developer (toner) from a development roller 104*a* onto the surface of the photosensitive drum 101, as a result of which the electrostatic latent image formed on the surface of the photosensitive drum 101 is sequentially developed as a toner image, which is a transferable image. A sheet feeding cassette 105 contains recording materials P in a stacked state. A sheet feeding roller 106 is driven based on a sheet feeding start signal, and the recording materials P contained in the sheet feeding cassette 105 are each separated from the others and are fed one by one. Then, the recording material P is introduced at a predetermined timing to a transfer portion 108T, which is an abutment nip portion between the photosensitive drum 101 and a transfer roller 108 rotating by being driven by a contact with the photosensitive drum 101, via a registration roller pair 107. In other words, the conveyance of the recording material P is controlled by the registration rollers 107 in such a manner that a leading edge of the toner image on the photosensitive drum 101 and a leading edge of the recording material P reach the transfer portion 108T at the same time. After that, the recording material P is conveyed through the transfer portion 108T while being sandwiched by the transfer portion 108T, during which a transfer voltage (a transfer bias) controlled in a predetermined manner is applied from a transfer bias application power source (not illustrated) to the transfer roller 108. The transfer bias having a reverse polarity of the toner is applied to the transfer roller 108, and the toner image on the surface side of the photosensitive drum 101 is electrostatically transferred onto a surface of the recording material P at the transfer portion 108T. The recording material P after the transfer of the toner image is separated from the surface of the photosensitive drum 101, is conveyed through a conveyance guide 109, and is introduced into an image heating apparatus A as an image heating apparatus. The recording material P is subjected to processing for fixing the toner image with use of heat at the image heating apparatus A. On the other hand, the surface of the photosensitive drum 101 after the transfer of the toner image onto the recording material P is subjected to a removal of toner remaining after the transfer, paper powder, and the like by a cleaning device 110 to thereby return to a clean surface, and then is repeatedly provided to be used in image formation. The recording material P after passing through the image heating apparatus A is discharged onto a sheet discharge tray 112 via a discharge port 111.

1-2. General Description of Image Heating Apparatus

Figure 2:
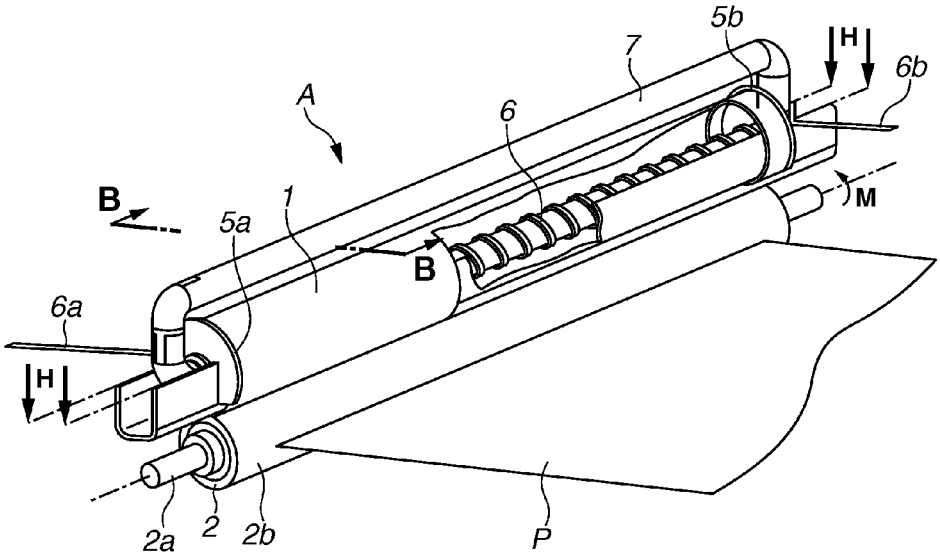
FIG. 2 is a perspective view illustrating main portions of the heating apparatus.
Figure 3:
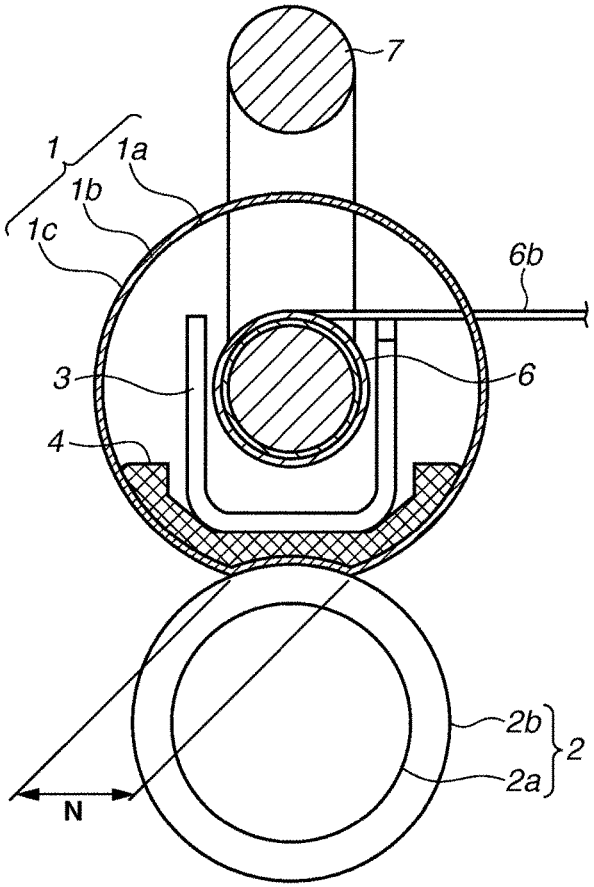
FIG. 3 is a cross-sectional view illustrating the heating apparatus according to the exemplary embodiment that is taken along a line B-B.

In the present exemplary embodiment, the image heating apparatus A is an apparatus that works according to the electromagnetic induction heating method. FIG. 2 is a perspective view illustrating main portions of the image heating apparatus A according to the present exemplary embodiment. FIG. 3 is a cross-sectional view taken along a line B-B illustrated in FIG. 2. Referring to FIG. 2, a fixing sleeve 1 is a rotatable member including a conductive layer (a heat generation layer). In the perspective view of FIG. 2, the fixing sleeve 1 is illustrated with use of a cutaway view of a central portion in a longitudinal direction for facilitating better understanding of the interior of the fixing sleeve 1. The fixing sleeve 1 is the rotatable member including a conductive layer 1*a* as a base layer, an elastic layer 1*b* formed around the conductive layer 1*a*, and a release layer 1*c* formed around the elastic layer 1*b*. A diameter of the fixing sleeve 1 is 10 to 50 mm. The conductive layer 1*a* is made of a metal having a film thickness of 10 to 50 μm. The elastic layer 1*b* is formed by shaping silicon rubber having a hardness of 20 degrees (Japanese Industrial Standards (JIS)-A, under a weight of one kg) into a layer having a thickness of 0.1 mm to 0.3 mm. Then, a fluorine-contained resin tube having a thickness of 10 μm to 50 μm is coated around the elastic layer 1*b* as the front layer 1*c* (i.e., the release layer) in such a manner that the elastic layer 1*b* is covered with this tube.

A pressure roller 2 works as a counter member, and includes a core metal 2*a*, an elastic layer 2*b* formed around the core metal 2*a*, and a release layer formed around the elastic layer 2*b*. The elastic layer 2*b* may desirably be made from a highly thermally-resistant material such as silicon rubber, fluorine-contained rubber, and fluorosilicone rubber. Both ends of the core metal 2*a* are rotatably held, and are rotationally driven by a driving source (not illustrated) in a direction indicated by an arrow M in FIG. 2 to apply a rotating force to the fixing sleeve 1 with the aid of a frictional force with an outer surface of the fixing sleeve 1, and also convey the recoding material P while sandwiching the recording material P. A U-shaped stay 3 receives a pressing force in a direction indicated by an arrow H in FIG. 2 to press a slidable member 4 illustrated in FIG. 3 toward the pressure roller 2, thereby forming a nip portion N. Flange members 5*a* and 5*b* illustrated in FIG. 2 are fitted around both ends of the fixing sleeve 1 on the left side and the right side, and regulate a lateral movement when the fixing sleeve 1 rotates. The flange members 5*a* and 5*b* may desirably be made from a highly thermally-resistant material such as liquid crystal polymer (LCP) resin.

An exciting coil 6 is disposed within the fixing sleeve 1. The exciting coil 6 is wound so as to form a helically shaped portion having an axis of a helix substantially in parallel with a generatrix direction of the fixing sleeve 1. The exciting coil 6 is used to produce an alternating magnetic field. The alternating magnetic field is a magnetic field having a magnitude and a direction repeatedly changing according to time. A magnetic core 7 is disposed within the helically shaped portion, and guides lines of magnetic force in the alternating magnetic field to form a magnetic path of the lines of magnetic force. The magnetic core 7 may desirably be made from a material having a small hysteresis loss and a high relative magnetic permeability, such as calcined ferrite, ferrite resin, an amorphous alloy, and a ferromagnetic material including an oxidized material or an alloy material having a high magnetic permeability such as a permalloy. In the present exemplary embodiment, calcined ferrite having a relative magnetic permeability of 1800 is used for the magnetic core 7.

A inverter circuit (not illustrated) is connected to both ends 6*a* and 6*b* of the exciting coil 6, and a high-frequency current (an alternating current) is supplied thereto. An alternating magnetic field produced by the high-frequency current induces an induced current in the conductive layer 1*a*, by which the fixing sleeve 1 (the conductive layer 1*a*) generates heat by electromagnetic induction. A commonly-used single conductive wire or the like can be used for the exciting coil 6. A high-frequency current within a range of 20.5 kHz to 100 kHz is supplied to this exciting coil 6 via the power supply contact portions 6*a* and 6*b* with use of a high-frequency converter or the like, by which a magnetic flux is produced. This magnetic flux causes an induced current to flow in the conductive layer 1*a*, leading to Joule heat generation. This heat is transmitted to the elastic layer 1*b* and the release layer 1*c*, thereby heating the entire fixing sleeve 1 to heat the recording material P conveyed through the fixing nip portion N to then fix the toner image.

1-3. Control of Printer

Figure 4:
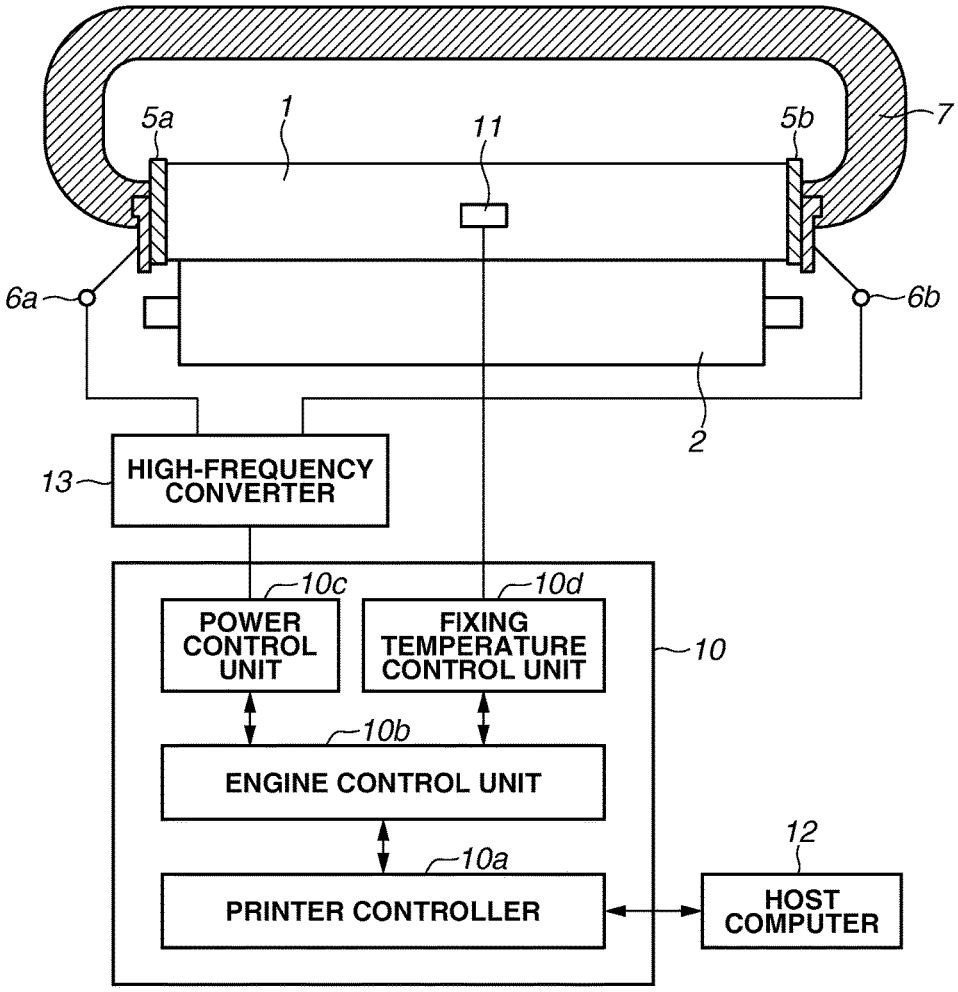
FIG. 4 is a front view of the heating apparatus and a block diagram of a printer control unit.

FIG. 4 is a front view of the image heating apparatus A and a block diagram of a printer control unit 10. A thermometry element 11 such as a non-contact type thermistor is disposed on an upstream side with respect to the conveyance of the recording material P into the image heating apparatus A, and at a central portion in the longitudinal direction. With the thermometry element 11, a temperature of the fixing sleeve 1 is maintained at a predetermined target temperature. A printer controller 10*a* performs communication with and receives image data from a host computer 12, and rasterizes the received image data into information that the printer can print. The printer controller 10*a* also exchanges signals and performs serial communication with an engine control unit 10*b*. The engine control unit 10*b* exchanges signals with the printer controller 10*a*, and further controls a power control unit 10*c* and a fixing temperature control unit 10*d* of a printer engine via serial communication. The fixing temperature control unit 10*d* controls the temperature of the image heating apparatus A based on a temperature detected by the thermometry element 11. The power control unit 10*d* serving as a power adjustment unit adjusts a voltage to be applied to the exciting coil 6 and controls power of a high-frequency converter 13.

In a printer system including the printer control unit 10 configured in this manner, the host computer 12 transfers the image data, and sets various printing conditions such as a size of the recording material P according to a request from a user.

1-4. Induced Current Produced in Body of Sleeve

Figure 5:
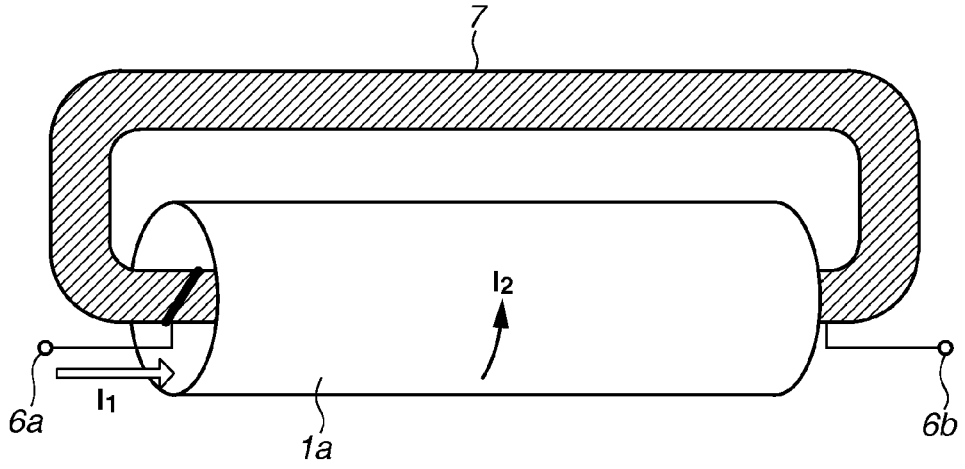
FIG. 5 illustrates a magnetic field and an induced current at the moment at which a current increases in an exciting coil in a direction indicated by an arrow.

FIG. 5 illustrates a magnetic field and an induced current at the moment at which a current increases in the exciting coil 6 in a direction indicated by an arrow $I_1$. The magnetic core 7 functions as a member for guiding lines of magnetic force produced at the exciting coil 6 into the magnetic core 7 to form a magnetic path. Therefore, most of the lines of magnetic force are guided into the magnetic core 7 to pass through within the magnetic core 7 (the magnetic path), thereby forming a closed magnetic path. Then, the fixing sleeve 1 is set up so as to surround this magnetic path. An alternating magnetic field is produced within the magnetic core 7. Then, an induced electromotive force is produced in a circumferential direction of the conductive layer 1*a* according to Faraday's law. Faraday's law defines that "a magnitude of an induced electromotive force E produced on the conductive layer 1*a* is proportional to a change rate of a magnetic field Φ perpendicularly penetrating this conductive layer 1*a*". Therefore, the induced electromotive force is expressed by the following expression, an expression (4-1).

$$E = -N\frac{\Delta\Phi}{\Delta t} \tag{4-1}$$

E: the induced electromotive force

N: the number of turns of the coil 6

ΔΦ/Δt: a change in the magnetic flux perpendicularly penetrating through the circuit during an extremely short time Δt When the current $I_1$ is supplied to the exciting coil 6, an alternating magnetic field is produced within the magnetic core 7, so that an induced electromotive force in the circumferential direction is produced over an entire region of the conductive layer 1*a* in the longitudinal direction thereof, whereby a circumferential current $I_2$ flows. Because the conductive layer 1*a* has an electric resistance, the flow of this circumferential current $I_2$ causes Joule heat generation. An operating principle for inducing this current $I_2$ is equivalent to magnetic coupling of a coaxial transformer.

1-5. High-Frequency Converter

Figure 6:
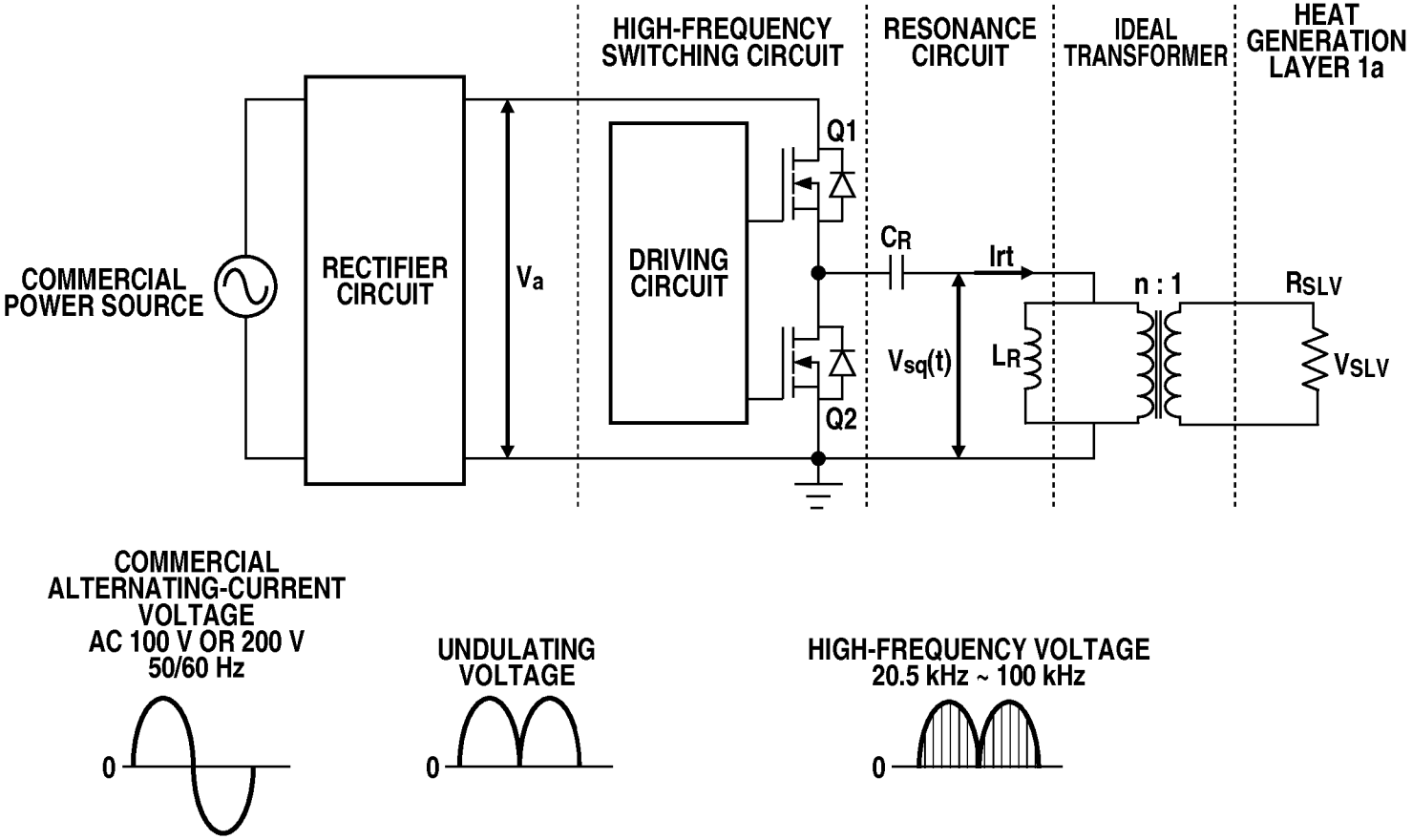
FIG. 6 illustrates a series resonance circuit, which is one specific example of a high-frequency converter.

FIG. 6 illustrates a relationship among a series resonance circuit, which is one specific example of the high-frequency converter 13, the exciting coil 6, and the conductive layer 1*a*. This mechanism is divided into a commercial power source, a rectifier circuit, a high-frequency switching circuit, a resonance circuit, an ideal transformer, and the conductive layer 1*a*. A commercial alternating-current voltage (e.g., AC 100 V or 200 V, 50/60 Hz) acquired from the commercial power source is converted into an undulating current by the rectifier circuit, and is supplied into the high-frequency switching circuit. Then, a voltage $V_a$ converted into the undulating current is supplied into the resonance circuit as a high-frequency current (e.g., 20.5 kHz to 100 kHz) by a switching element such as an insulated gate bipolar transistor. Hereinafter, the insulated gate bipolar transistor will be referred to as the IGBT. Driving of this IGBT (i.e., switching between an ON state and an OFF state) is controlled by a driving circuit. In the resonance circuit, a resonance capacitor $C_R$ and the exciting coil $L_R$ constitute a series resonance circuit. In the series resonance circuit, an impedance is minimized when an output frequency matches a resonance frequency $f_R$, so that a largest amount of a current flows therethrough. The resonance frequency $f_R$ of the series resonance circuit can be acquired by the following expression, an expression (5-1).

$$f_R = \frac{1}{2\pi\sqrt{L_R C_R}} \tag{5-1}$$

In the present exemplary embodiment, as a result of measuring an inductance of the exciting coil 6 with use of an inductance-capacitance-resistance (LCR) meter, $L_R$=14 μH was acquired. Therefore, for example, when a capacitance of the resonance capacitor $C_R$ is set as $C_R$=2 μF, the resonance frequency $f_R$ can be calculated as $f_R$=30 kHz from the expression (5-1). Therefore, when a high-frequency current of 30 kHz is produced, the current flowing through the resonance circuit is maximized, so that a heat amount generated on the heat generation member is also maximized. The capacitance of this resonance capacitor $C_R$ can be selected according to the inductance $L_R$ of the exciting coil 6 and a frequency that the user wants to use.

A voltage $V_{sq}(t)$ at a certain moment in the resonance circuit can be expressed by an expression (5-2) and an expression (5-3) with use of a Fourier series, assuming that $f_{sw}$ represents a switching frequency. In this high-frequency converter 13, a relationship between an effective value voltage $V_a$ supplied to the high-frequency switching circuit and an effective value voltage $V_{FHA}$ supplied to the resonance circuit can be expressed by an expression (5-4) with use of a primary high harmonic approximation.

$$V_{sq}(t) = \frac{V_a}{2} + \frac{2}{\pi}V_a \sum_{n=1,3,5\ldots} \frac{1}{n}\sin(n2\pi f_{sw}t) \tag{5-2}$$

$$V_{FHA}(t) = \frac{2}{\pi}V_a \sin(2\pi f_{SW}t) \tag{5-3}$$

$$V_{FHA} = \frac{\sqrt{2}}{\pi}V_a \tag{5-4}$$

In this case, assuming $V_a$=$V_e$, $V_{FHA}$ can be expressed by the following expression, an expression (5-5).

$$V_{FHA} = \frac{\sqrt{2}}{\pi}V_e \tag{5-5}$$

Further, assuming that $V_m$ represents a maximum value of the voltage of the commercial power source, $V_{FHA}$ is expressed by the following expression, an expression (5-6).

$$V_{FHA} = \frac{\sqrt{2}}{\pi} \times \frac{1}{\sqrt{2}} \times V_m = \frac{V_m}{\pi} \tag{5-6}$$

1-6. Method for Calculating Power According to Transformer Model

Figure 7:
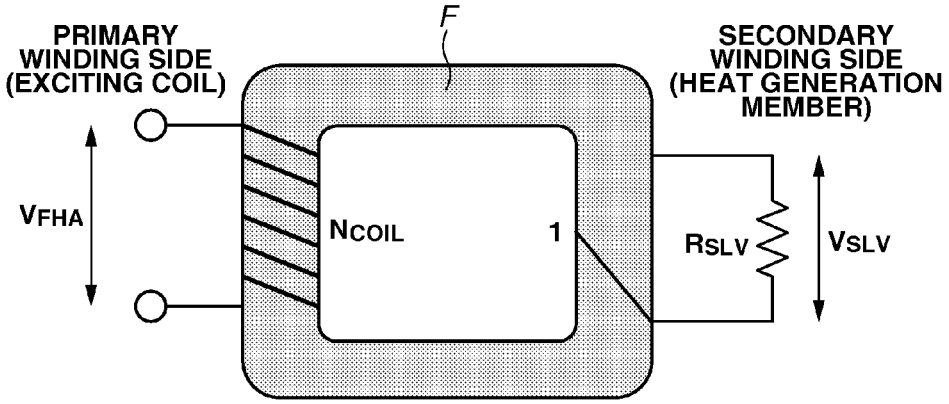
FIG. 7 illustrates a model of a transformer corresponding to the exciting coil and a heat generation member.

FIG. 7 illustrates a model of a transformer corresponding to the exciting coil 6 and the heat generation member. A relationship between the voltage $V_{FHA}$ applied to the exciting coil 6 and the heat amount generated on the cylindrical heat generation member (power $P_{SLV}$ used for the heat generation of the cylindrical heat generation member) can be approximated from an expression of a transformer ratio of a transformer. The high-frequency voltage $V_{FHA}$ is produced on a primary winging side (the exciting coil 6). As a result, an induced electromotive force $V_{SLV}$ is applied to a secondary winding side (the heat generation member) via the magnetic core F, and is consumed by a resistance $R_{SLV}$ as heat, leading to generation of the heat amount (=power) $P_{SLV}$. In this case, the number of turns of the secondary-side coil can be regarded as one turn. Then, assuming that $N_{COIL}$ represents the number of turns of the primary-side coil (the exciting coil 6), a relationship of the following expression, an expression (6-1) is established among $V_{FHA}$, $V_{SLV}$, and $N_{COIL}$ from the expression of the transformer ratio.

$$\frac{N_{COIL}}{1} = \frac{V_{FHA}}{V_{SLV}} \tag{6-1}$$

The following expression, an expression (6-2) can be acquired by transforming the expression (6-1).

$$V_{SLV} = \frac{1}{N_{COIL}} \times V_{FHA} \tag{6-2}$$

Further, a relationship of the following expression, an expression (6-3) can be acquired with use of the expression (6-2), with $P_{SLV}$ representing the heat amount (=power) generated on the cylindrical heat generation member, and $R_{SLV}$ representing a circumferential resistance of the heat generation member.

$$P_{SLV} = \frac{V_{SLV}^2}{R_{SLV}} = \frac{\left(\frac{V_{FHA}}{N_{COIL}}\right)^2}{R_{SLV}} \tag{6-3}$$

The circumferential resistance $R_{SLV}$ of the heat generation member is an electric resistance when a current flows in the circumferential direction of the conductive layer 1*a*.

Figure 8:
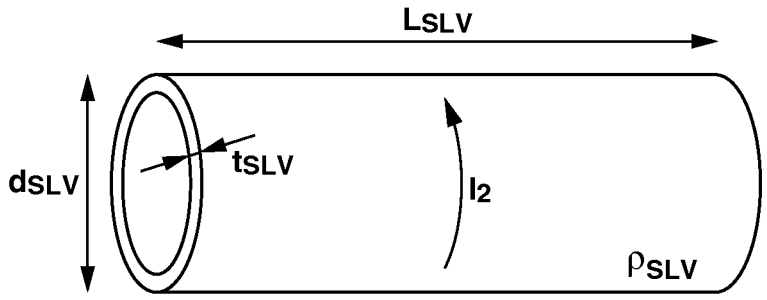
FIG. 8 illustrates a shape of a conductive layer and a method for calculating a circumferential resistance.

FIG. 8 illustrates parameters of the conductive layer 1*a* required to calculate the circumferential resistance $R_{SLV}$ of the conductive layer 1*a*. These parameters are a length $L_{SLV}$ [m] of the conductive layer 1*a* in the longitudinal direction thereof, a diameter (an outer diameter) $d_{SLV}$ [m], a thickness $t_{SLV}$ [m], and a volume resistivity $\rho_{SLV}$ [Ωm]. In this case, the electric resistance (the circumferential resistance) $R_{SLV}$ in the circumferential direction can be expressed by the following expression, an expression (6-4).

$$R_{SLV} = \frac{\rho_{SLV} \times \pi d_{SLV}}{t_{SLV} \times L_{SLV}} \tag{6-4}$$

In this case, a value indicated in a table 1 is acquired by calculating the circumferential resistance $R_{SLV}$ of the conductive layer 1*a* according to the first exemplary embodiment using the expression (6-4). Stainless steel is used as the material of the conductive layer 1*a*.

TABLE 1

| | SYMBOL | NUMERICAL VALUE | UNIT |
|---|---|---|---|
| VOLUME RESISTIVITY | ρ | 7.2E−07 | Ωm |
| DIAMETER | d | 3.0E−02 | m |
| THICKNESS | t | 3.5E−05 | m |
| LONGITUDINAL LENGTH | L | 2.3E−01 | m |
| CIRCUMFERENTIAL RESISTANCE | R | 8.4E−03 | Ω |

A value indicated in a table 2 is acquired by calculating the power generated from the heat generation member when the effective value voltage of the commercial power source is 100 V according to the expression (6-3) with use of the expressions (5-6) and (6-4). Therefore, 939 [W] can be acquired as the generated heat amount.

TABLE 2

| | SYMBOL | NUMERICAL VALUE | UNIT |
|---|---|---|---|
| EFFECTIVE VALUE VOLTAGE | $V_e$ | 100 | V |
| FHA VOLTAGE | $V_{FHA}$ | 45.0 | V |
| NUMBER OF TURNS OF COIL | $N_{COIL}$ | 16 | NONE |
| CIRCUMFERENTIAL RESISTANCE | $R_{SLV}$ | 8.4E−03 | Ω |
| GENERATED HEAT AMOUNT | $P_{SLV}$ | 939 | W |

1-7. Number of Turns of Exciting Coil and Parasitic Capacitance

Figure 9A:
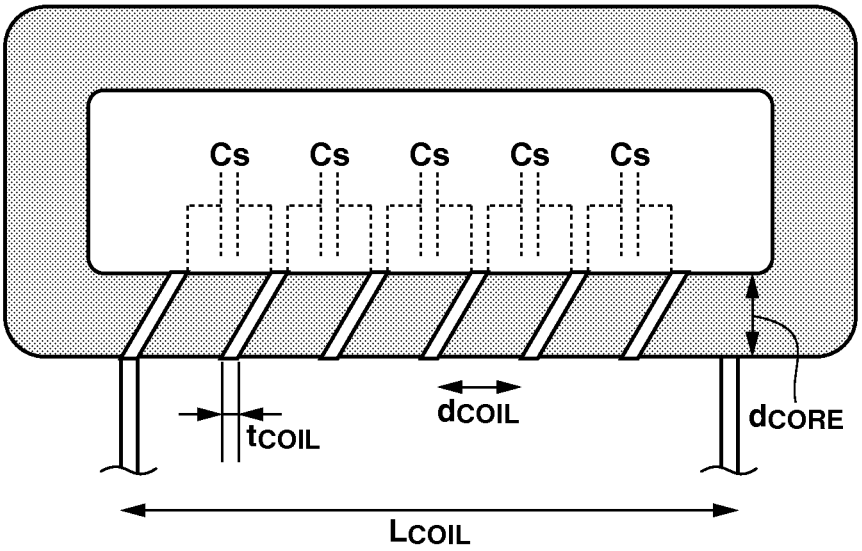
FIGS. 9A and 9B are conceptual diagrams illustrating how metals of coil wires operate as a capacitor.
Figure 9B:
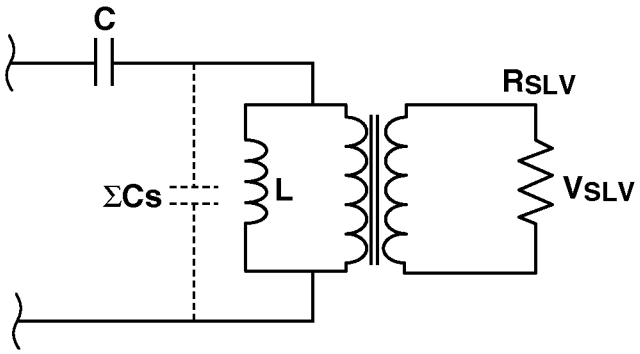

An electrostatic capacitance is inevitably formed between adjacent metals. Among such capacitances, an electrostatic capacitance formed at a portion unintended by a designer is referred to as a parasitic capacitance (a stray capacitance or a floating capacitance). Also in the image heating apparatus A according to the present exemplary embodiment, if the exciting coil 6 is wound by a large number of turns, metals of adjacent coil wires behave like electrode plates of capacitors, and store electric charges, as indicated by dotted lines in FIG. 9A. As illustrated in FIG. 9B, these parasitic capacitances between the wound wires of the coil 6 behave as if a capacitor having a capacitance of $\Sigma C_s$ (a sum of parasitic capacitances $C_s$ between the respective wires) is connected in parallel with the coil 6, resulting in a flow of an undesired current to charge and discharge these capacitances. If the supplied current is a low-frequency current (e.g., 50 to 60 Hz), this undesired current can be ignored, provided that the voltage is changed at a relatively low speed. However, if the voltage is changed at a high speed (e.g., 20.5 kHz to 100 kHz), this charging amount also increases, leading to occurrence of oscillation and then generation of a noise. A parameter that most largely contributes to a magnitude of this parasitic capacitance is a coil interval.

In the following description, a method for approximately calculating the parasitic capacitance $C_{STR}$ from the number of turns of the coil 6, and how much the coil interval contributes thereto will be described, assuming that a naked wire having a square shape in cross-section (for simplification of the description) is used as the coil 6. An expression (7-1) can be acquired as an expression for calculating the electrostatic capacitance from an electric permittivity $\epsilon_0$ of a vacuum, a relative electric permittivity $\epsilon$ of air, an area $S_{COIL}$ of facing surfaces between the coil wires, and the coil interval $d_{COIL}$, when air exists between the wound wires of the coil 6.

$$C_{STR} = \varepsilon_0 \varepsilon \frac{S_{COIL}}{d_{COIL}} \tag{7-1}$$

The coil interval $d_{COIL}$ can be acquired according to an expression (7-2) from a length $L_{COIL}$ of a portion of the core 7 around which the coil 6 is wound in the longitudinal direction, the number of turns $N_{COIL}$, and a wire width $t_{COIL}$. The length $L_{COIL}$ can be also defined as a length where the helically shaped portion of the coil 6 and the core 7 overlap each other in the generatrix direction of the fixing sleeve 1.

$$d_{COIL} = \frac{L_{COIL}}{N_{COIL}} - t_{COIL} \tag{7-2}$$

The area $S_{COIL}$ of the facing surfaces between the coil wires can be calculated according to an expression (7-3) from a length $\pi d_{CORE}$ of one turn of the coil 6 ($d_{CORE}$ is a diameter of the core 7), the wire width $t_{COIL}$, and the number of turns $N_{COIL}$. The wound wire of the coil 6 has a square shape in cross-section.

$$S_{COIL} = \pi d_{CORE} \times t_{CORE} \times (N_{COIL} - 1) \tag{7-3}$$

If the expressions (7-2) and (7-3) are substituted into the expression (7-1), the parasitic capacitance $C_{STR}$ is expressed by an expression (7-4).

$$C_{STR} = \varepsilon_0 \varepsilon \frac{(\pi d_{CORE} \times t_{COIL} \times (N_{COIL} - 1))}{\left(\frac{L_{COIL}}{N_{COIL}} - t_{COIL}\right)} \tag{7-4}$$

The following table 3 indicates a result of the calculation of the parasitic capacitance $C_{STR}$ according to the present exemplary embodiment, which is performed with use of the expression (7-4).

TABLE 3

| | SYMBOL | NUMERICAL VALUE | UNIT |
|---|---|---|---|
| DIAMETER OF CORE | $d_{CORE}$ | 14.0 | mm |
| NUMBER OF TURNS OF COIL | $N_{COIL}$ | 16 | NONE |
| LONGITUDINAL LENGTH | $L_{COIL}$ | 230 | mm |
| WIDTH OF COIL WIRE | $t_{COIL}$ | 2 | mm |
| ELECTRIC PERMITTIVITY OF VACUUM | $\epsilon_0$ | 8.85E−12 | F/m |
| RELATIVE ELECTRIC PERMITTIVITY | $\epsilon$ | 1.00059 | NONE |
| AREA OF FACING SURFACES | $S_{COIL}$ | 1319 | $mm^2$ |
| INTERVAL | $d_{COIL}$ | 12.4 | mm |
| PARASITIC CAPACITANCE | $C_{STR}$ | 0.94 | pF |

The image heating apparatus A according to the first exemplary embodiment is designed in such a manner that the parasitic capacitance is sufficiently reduced.

Figure 11A:
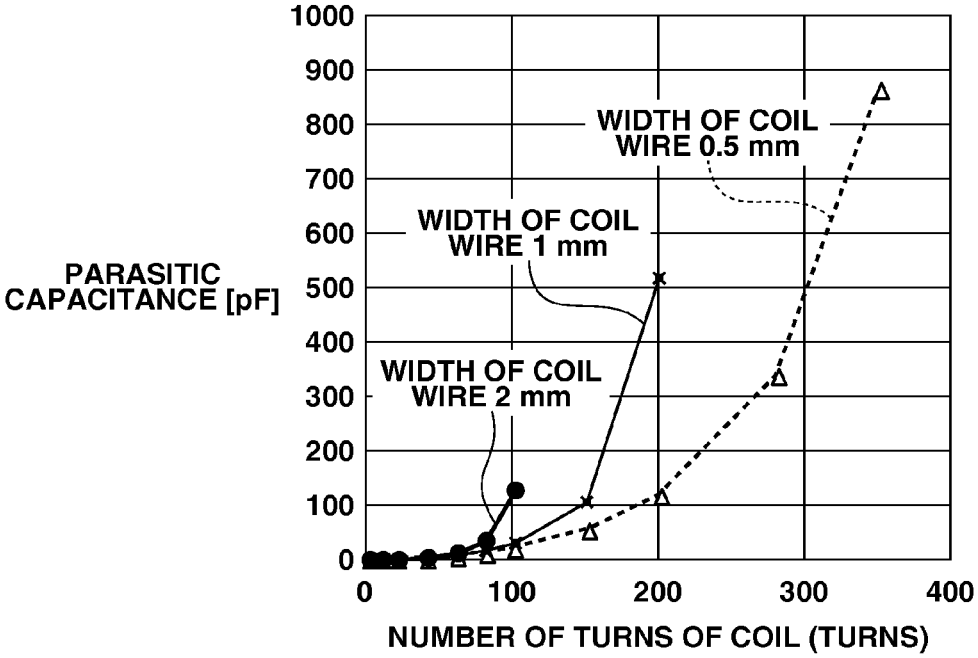
FIGS. 11A and 11B illustrate graphs that indicate relationships between the number of turns of the coil and a coil interval, and a parasitic capacitance, respectively.
Figure 11B:
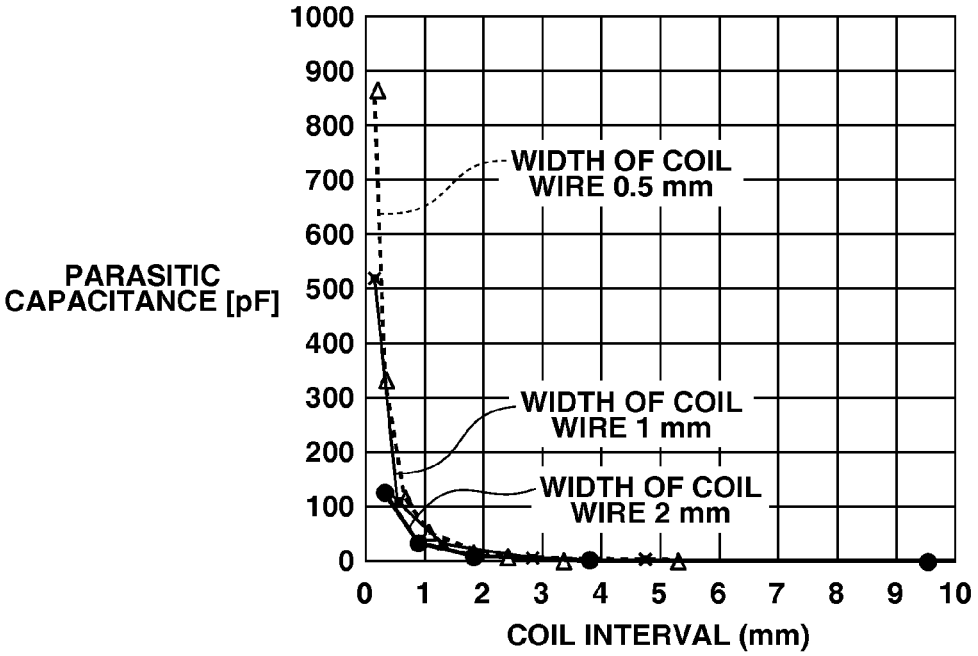

FIG. 11A illustrates a graph that indicates a relationship between the number of turns of the coil 6 and the parasitic capacitance. The calculation is made with the width of the coil wire categorized into three types, 2 mm, 1 mm, and 0.5 mm. Further, the calculation is made assuming that the diameter of the core 7 is 14 mm, and the length of the core 7 in the longitudinal direction is 230 mm. FIG. 11B illustrates a graph that indicates a relationship between the coil interval and the parasitic capacitance. The parasitic capacitance increases as the coil interval decreases, and increase rates of the respective widths are generally similar to one another almost regardless of the width of the coil wire. In other words, it can be understood from the graph of FIG. 11B that the parasitic capacitance depends little on the width of the coil wire, and is largely affected by the relationship between the coil interval and the parasitic capacitance. This result is only an approximate calculation, but provides knowledge about the coil interval that can sufficiently reduce the influence of the parasitic capacitance.

For reference, it is desirable to reduce the parasitic capacitance to approximately 100 pF or smaller. This is because a voltage resonance capacitor may be provided in the resonance circuit to eliminate or reduce a switching loss and a switching noise, and a capacitance thereof is approximately 500 pF to 2000 pF. An increase in the parasitic capacitance to a non-negligible degree with respect to this capacitance makes it difficult to work out a design for reducing a switching loss and a switching noise. It can be concluded from this requirement together with the above-described approximate calculation that "it is possible to sufficiently reduce the influence of the parasitic capacitance by setting the coil interval to 1 mm or longer".

This design is difficult to be achieved in a normal transformer design. This is because the length $L_{COIL}$ illustrated in FIG. 9A is short in this case. The present exemplary embodiment is a design that makes best use of the fact that this apparatus is an image heating apparatus and therefore requires the dimension of the length $L_{COIL}$ substantially equal to a length of an image heating region.

Figure 10:
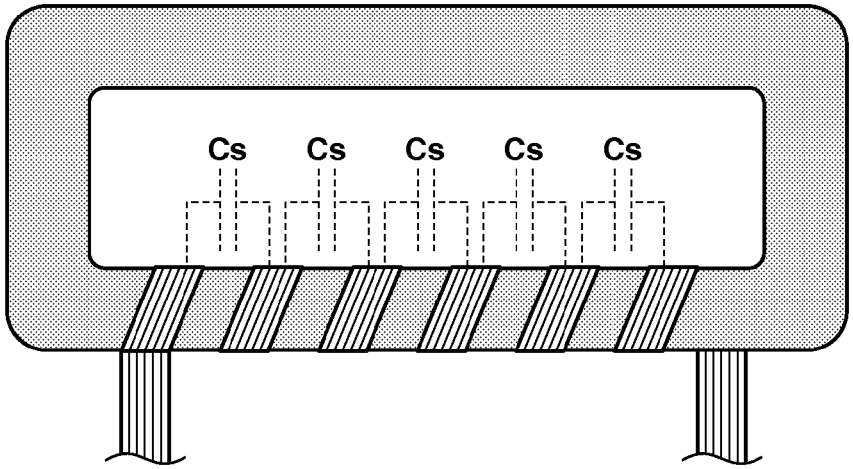
FIG. 10 is a conceptual diagram illustrating how metals of Litz wires operate as a capacitor.

If a Litz wire formed by bundling thin wires together is used for the exciting coil 6, one bundle of the Litz wire can be handled in a similar manner to the single conductive wire described in the present exemplary embodiment. This is because electric potentials are completely the same within one bundle of the Litz wire, whereby no parasitic capacitance is formed between portions away from the contact point by equal distances. Therefore, as illustrated in FIG. 10, parasitic capacitances are formed at similar portions to the configuration illustrated in FIG. 9A.

1-8. Condition Required for Circumferential Resistance of Sleeve

A condition for achieving the coil interval of 1 mm or longer will be described in detail. First, an input voltage of the commercial power source and maximum power of the image heating apparatus are determined according to specifications of a product. It is necessary to control the circumferential resistance of the sleeve to realize an image heating apparatus that can reduce the parasitic capacitance and prevent generation of a noise under these constraint conditions.

In the following description, a relationship between the circumferential resistance of the sleeve and the parasitic capacitance will be described.

Regarding the number of turns, a relationship of an expression (8-1) can be acquired by transforming the expression (6-3).

$$N_{COIL} = \frac{V_{FHA}}{\sqrt{P_{SLV} R_{SLV}}} \tag{8-1}$$

Then, a relationship of an expression (8-2) can be acquired by substituting the expression (5-5) into the expression (8-1) to eliminate $V_{FHA}$.

$$N_{COIL} = \frac{\frac{\sqrt{2}}{\pi} V_e}{\sqrt{P_{SLV} R_{SLV}}} = \frac{\sqrt{2} V_e}{\pi \sqrt{P_{SLV} R_{SLV}}} \tag{8-2}$$

As a condition that the number of turns $N_{COIL}$ should satisfy, first, the number of turns $N_{COIL}$ should be one or larger as a minimum value. This is because the coil cannot fulfill the function as the exciting coil unless the coil is wound at least once or more. Therefore, the number of turns $N_{COIL}$ should satisfy a relationship of the following expression (8-3).

$$1 \leq N_{COIL} \tag{8-3}$$

Next, a relationship of an expression (8-4) can be acquired from the relationship among $L_{COIL}$, $d_{COIL}$, and $t_{COIL}$, which is acquired by transforming the expression (7-2).

$$N_{COIL} = \frac{L_{COIL}}{d_{COIL} + t_{COIL}} \tag{8-4}$$

$L_{COIL}$: the length of the portion of the core 7 around which the coil 6 is wound in the longitudinal direction $N_{COIL}$: the number of turns of the coil 6

$t_{COIL}$: the width of the coil wire

Then, a maximum value N(MAX) of the number N, which is expressed by an expression (8-5), can be acquired by substituting d=1 mm into the expression (8-4).

$$N_{COIL}(\mathrm{MAX}) = \frac{L_{COIL}}{d_{COIL}(=1\ \mathrm{mm}) + t_{COIL}} \tag{8-5}$$

Therefore, the condition that $N_{COIL}$ should satisfy is as indicated by an expression (8-6).

$$1 \leq N_{COIL} \leq \frac{L_{COIL}}{d_{COIL}(=1\ \mathrm{mm}) + t_{COIL}} \tag{8-6}$$

A relationship of an expression (8-7) can be acquired from the expressions (8-6) and (8-2).

$$1 \leq \frac{\sqrt{2} V_e}{\pi \sqrt{P_{SLV} R_{SLV}}} \leq \frac{L_{COIL}}{d_{COIL}(=1\ \mathrm{mm}) + t_{COIL}} \tag{8-7}$$

The following table 4 indicates calculated values of a central term of the expression (8-7).

TABLE 4

| | SYMBOL | NUMERICAL VALUE | NUMERICAL VALUE | UNIT |
|---|---|---|---|---|
| EFFECTIVE VALUE VOLTAGE | $V_e$ | 100 | 100 | V |
| GENERATED HEAT AMOUNT | $P_{SLV}$ | 1000 | 1000 | W |

TABLE 4-continued

| | SYMBOL | NUMERICAL VALUE | NUMERICAL VALUE | UNIT |
|---|---|---|---|---|
| NUMBER OF TURNS OF COIL | $N_{COIL}$ | 1.0 | 115.0 | NONE |
| CIRCUMFERENTIAL RESISTANCE | $R_{SLV}$ | 10 | 8E−04 | Ω |

The following table 5 indicates calculated values of a term on the right side of the expression (8-7).

TABLE 5

| | SYMBOL | NUMERICAL VALUE | UNIT |
|---|---|---|---|
| INTERVAL | $d_{COIL}$ | 1.0 | mm |
| LONGITUDINAL LENGTH | $L_{COIL}$ | 230 | mm |
| WIDTH OF COIL WIRE | $t_{COIL}$ | 1 | mm |
| NUMBER OF TURNS OF COIL WHEN INTERVAL IS 1 mm | $N_{COIL}$ | 115 | NONE |

Because $N_{COIL}$=15.5, this configuration satisfies the condition $1 \leq X \leq 115$ according to the expression (8-7), and therefore satisfies the "condition required for the circumferential resistance of the sleeve". Accordingly, the configuration according to the first exemplary embodiment can provide a fixing apparatus that does not generate a radiated noise and the like and stably operates even when a part of the core 7 is inserted through the hollow portion of the fixing sleeve 1 (the conductive layer 1*a*), and a high-frequency alternating current is supplied to the exciting coil 6 helically wound around the core 7.

Specific examples of numerical values that satisfy the "condition required for the circumferential resistance of the sleeve" will be described. These values are only one example and one rough standard for realizing an output of 1000 W with use of the exciting coil having a width of 230 mm. A range of the circumferential resistance that can satisfy $1 \leq X \leq 115$ is $0.8\ m\Omega \leq R_{SLV} \leq 10\Omega$. A table 6 indicates a result of calculating how large a design value of the thickness is for each of the minimum value and the maximum value of the circumferential resistance when the image heating apparatus is designed with use of metals having different volume resistivities under this condition.

1-9. Result of Comparison Experiment

In the following description, a result of an experiment for comparing the image heating apparatus A according to the present exemplary embodiment and a conventional image heating apparatus will be described.

<Comparative Example 1 >

A comparative example 1 was configured in such a manner that a cylindrical heat generation member had a low volume resistivity, compared to the first exemplary embodiment.

The heat generation member of the comparative example 1 was made from iron, and had a diameter of 6 cm, a thickness of 5 mm, and a length of 230 mm in the longitudinal direction. The heat generation member in this case had a circumferential resistance as indicated in the following table 7.

TABLE 7

| | SYMBOL | NUMERICAL VALUE | UNIT |
|---|---|---|---|
| VOLUME RESISTIVITY | ρ | 9.0E−08 | Ωm |
| DIAMETER | d | 6.0E−02 | m |
| THICKNESS | t | 5.0E−03 | m |
| LONGITUDINAL LENGTH | L | 2.3E−01 | m |
| CIRCUMFERENTIAL RESISTANCE | R | 1.5E−05 | Ω |

Under this circumferential resistance, the number of turns of the coil should be 371 turns to realize the output of 1000 W.

TABLE 8

| | SYMBOL | NUMERICAL VALUE | UNIT |
|---|---|---|---|
| EFFECTIVE VALUE VOLTAGE | $V_a$ | 100 | V |
| CIRCUMFERENTIAL RESISTANCE | $R_{SLV}$ | 1.5E−05 | Ω |
| GENERATED HEAT AMOUNT | $P_{SLV}$ | 1000 | W |
| NUMBER OF TURNS OF COIL | $N_{COIL}$ | 371.0 | NONE |

Because X=371, this configuration does not satisfy the condition $1 \leq X \leq 115$, and therefore does not satisfy the "condition required for the circumferential resistance of the sleeve".

TABLE 6

| | | | STAINLESS STEEL | | IRON | | NICKEL | | ALUMINUM | |
|---|---|---|---|---|---|---|---|---|---|---|
| | SYMBOL | UNIT | MINIMUM VALUE | MAXIMUM VALUE | MINIMUM VALUE | MAXIMUM VALUE | MINIMUM VALUE | MAXIMUM VALUE | MINIMUM VALUE | MAXIMUM VALUE |
| CIRCUMFERENTIAL RESISTANCE | R | Ω | 8.0E−04 | 10 | 8.0E−04 | 10 | 8.0E−04 | 10 | 8.0E−04 | 10 |
| VOLUME RESISTIVITY | ρ | Ωm | 7.2E−07 | 7.2E−07 | 8.9E−08 | 8.9E−08 | 6.8E−08 | 6.8E−08 | 2.7E−08 | 2.7E−08 |
| DIAMETER | d | m | 3.0E−02 | 3.0E−02 | 3.0E−02 | 3.0E−02 | 3.0E−02 | 3.0E−02 | 3.0E−02 | 3.0E−02 |
| LONGITUDINAL LENGTH | L | m | 2.3E−01 | 2.3E−01 | 2.3E−01 | 2.3E−01 | 2.3E−01 | 2.3E−01 | 2.3E−01 | 2.3E−01 |
| THICKNESS | t | μm | 369 | 0.030 | 45.6 | 0.004 | 35.0 | 0.003 | 13.6 | 0.001 |

The following table 9 indicates an approximate calculation of the parasitic capacitance, and a result of evaluation of a switching noise when the first exemplary embodiment and the comparative example 1 were actually used as the image heating apparatus.

TABLE 9

| | STRAY CAPACITANCE [pF] | NOISE LEVEL |
|---|---|---|
| FIRST EXEMPLARY EMBODIMENT | 0.65 | ○ |
| COMPARATIVE EXAMPLE | 591 | Δx |

The comparative example 1 generated a large switching noise, while the first exemplary embodiment generated no noise and was in an excellent state.

As described above, the configuration according to the first exemplary embodiment has an effect of being able to provide an image heating apparatus that can prevent the high-frequency current from oscillating and therefore can reduce generation of a switching loss and a switching noise from this oscillation.

Figure 12:
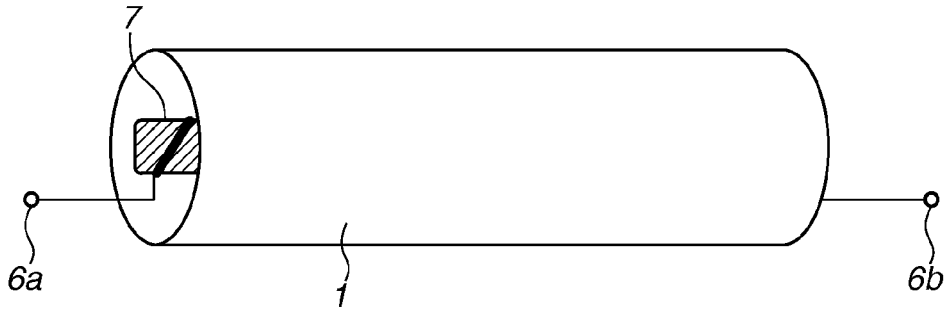
FIG. 12 illustrates a configuration of an opened magnetic path.

A second exemplary embodiment will be described as a configuration in which the magnetic core inserted in the hollow portion of the cylindrical rotatable member forms an opened magnetic path. In this case, a substantially even strong magnetic path should be formed in an entire region in the longitudinal direction of the cylindrical rotatable member. FIG. 12 illustrates the apparatus configuration. The magnetic core 7 is inserted through the hollow portion of the fixing sleeve 1 as the cylindrical rotatable member, and forms a continuous magnetic path over the entire fixing sleeve 1 in the longitudinal direction of the fixing sleeve 1. Calcined ferrite having a relative magnetic permeability of 1800 is used as the material of the magnetic core 7. The magnetic core 7 has a diameter of 14 mm in cross-section, and has an equal longitudinal length to the fixing sleeve 1.

The second exemplary embodiment is similar to the first exemplary embodiment except for use of an opened magnetic path. The conductive layer, the elastic layer, and the front layer of the fixing sleeve 1 are similar to those of the first exemplary embodiment, and the exciting coil, the thermometry element, and the temperature control method are similar to those of the first exemplary embodiment. However, a condition that will be described below should be satisfied to achieve the operating principle (described in detail in the section 1-4) equivalent to magnetic coupling of a coaxial transformer with use of an opened magnetic path.

Figure 13A:
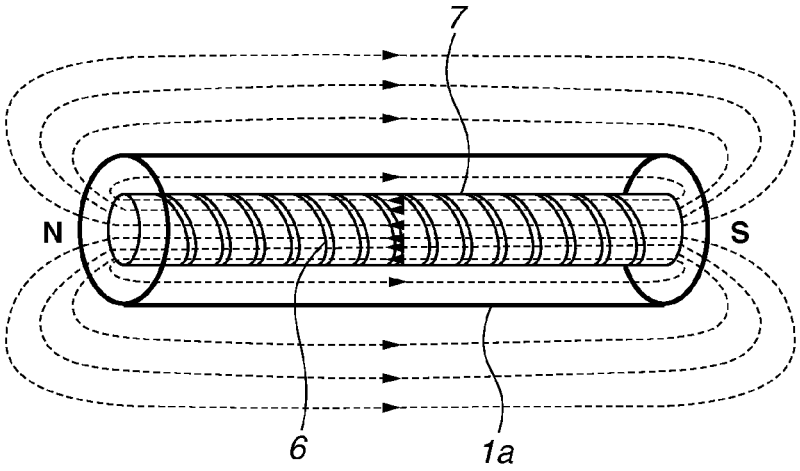
FIGS. 13A, 13B, and 13C illustrate shapes of lines of magnetic force.
Figure 13B:
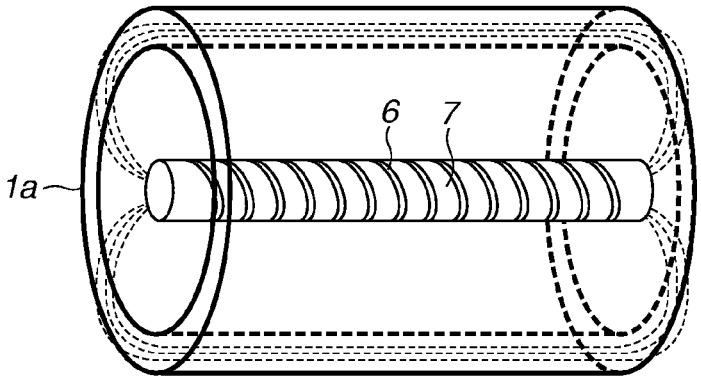

2-1. Condition for Achieving Operating Principle Equivalent to Magnetic Coupling of Coaxial Transformer In the section 1-4 described above, an induced magnetomotive force is produced in the circumferential direction of the conductive layer 1*a* according to Faraday's law. Faraday's law defines that "the magnitude of the induced electromotive force E produced on the conductive layer 1*a* is proportional to the change rate of the magnetic field Φ perpendicularly penetrating this conductive layer 1*a*". Therefore, a design guideline is to design "a state in which more perpendicular components of lines of magnetic force pass through inside the conductive layer 1*a* of the fixing sleeve 1", so as to efficiently produce the induced electromotive force E on the conductive layer 1*a* of the fixing sleeve 1. Therefore, an example illustrated in FIG. 13A is a desirable state, while an example illustrated in FIG. 13B is an undesirable state. The reason therefor is as follows. In the state illustrated in FIG. 13B, lines of magnetic force pass through within the material of the cylindrical rotatable member, and this case corresponds to a method for generating heat with use of an eddy current produced in the body of the heat generation rotatable member, as the conventional technique. Such shapes of lines of magnetic force are established, for example, when the cylindrical rotatable member has a high relative magnetic permeability, when the cylindrical rotatable member has a large cross-sectional area, when the magnetic core 7 has a small cross-sectional area, when the magnetic core 7 has a low relative magnetic permeability, and when the magnetic core 7 is divided in the longitudinal direction with a gap formed between divided core pieces.

Figure 14A:
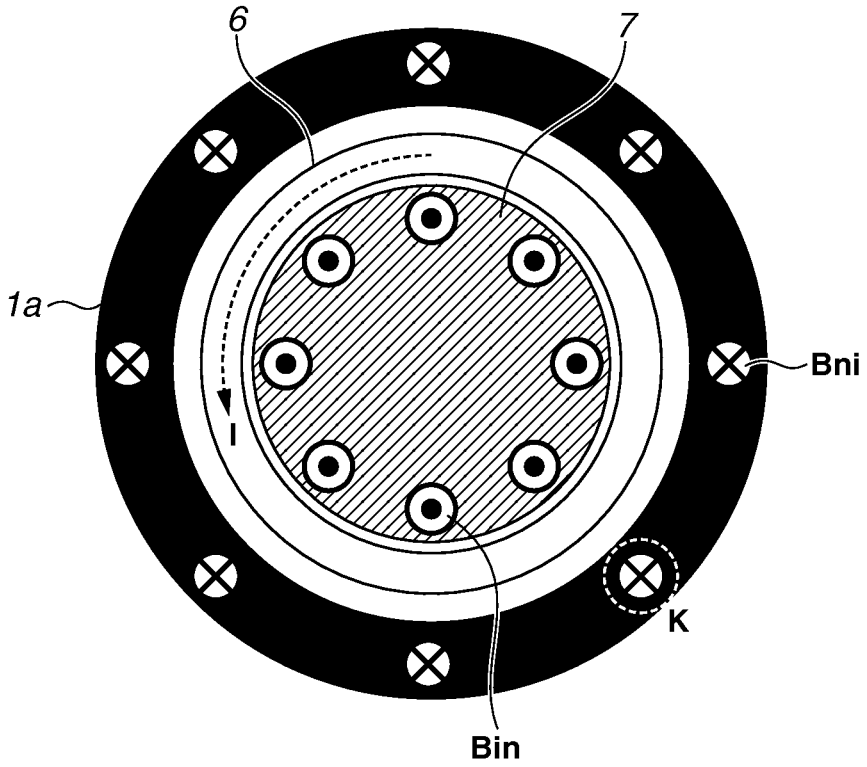
FIGS. 14A and 14B are schematic cross-sectional views.
Figure 14B:
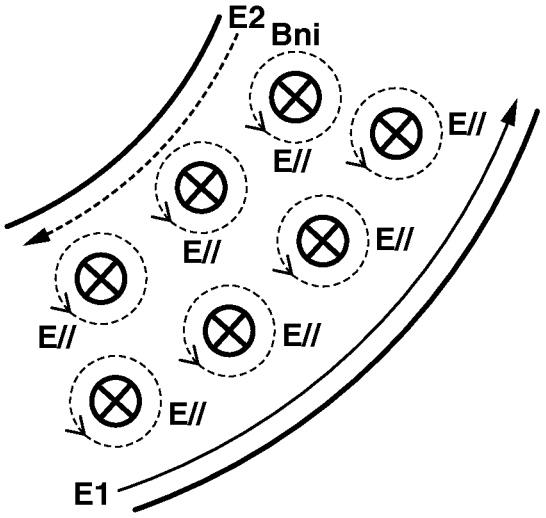

Therefore, when lines of magnetic force are produced in the configuration illustrated in FIG. 13B, the roller base layer 1*a* as the cylindrical member serves as a main magnetic path, and no magnetic path is formed outside the body of the cylindrical member. The shapes of lines of magnetic force in this case are such shapes that a magnetic flux produced from the magnetic core 7 is immediately introduced into the body of the conductive layer 1*a* of the fixing roller 1, and returns through the body of the conductive layer 1*a* of the fixing roller 1. FIG. 14A is a cross-sectional view of a central position. This is a schematic view illustrating lines of magnetic force at the moment at which a current in the coil 6 increases in a direction indicated by an arrow I. Lines of magnetic force Bin passing through the magnetic path are indicated by arrows pointing in the forward direction in FIG. 14A (eight white circles with black circles contained therein). Then, arrows pointing in the backward direction in FIG. 14A (eight white circles with cross marks contained therein) represent lines of magnetic force Bni returning through the body of the conductive layer 1*a* of the fixing roller 1. As illustrated in FIG. 14B, a large number of eddy currents E// are produced in the body of the conductive layer 1*a* of the fixing roller 1 so as to form a magnetic field that disturbs a change in the magnetic field indicated by the white circles with the cross marks contained therein. FIG. 14B is an enlarged view illustrating a portion K in FIG. 14A as a representative. More strictly speaking, the eddy currents E// have portions canceling out each other, and portions enhancing each other between adjacent eddy currents, and sums E1 and E2 of the eddy currents indicated by dotted arrows become dominant in the end. Hereinafter, the currents E1 and E2 will be referred to as "skin currents". When these skin currents E1 and E2 are produced in the circumferential direction, Joule heat is generated proportionally to a skin resistance of the conductive layer 1*a* of the fixing roller 1. These currents are also repeatedly produced and vanished, and have directions repeatedly reversing in synchronization with the high-frequency current.

Generally, this heat generation by the eddy currents E//, or the heat generation by the skin currents E1 and E2 is referred to as an "iron loss", and is expressed by the following expression (11-1).

$$P_e = k_e \frac{(tfB_m)^2}{\rho} \tag{11-1}$$

$P_e$: the heat generation amount generated by the eddy-current loss t: the thickness of the fixing roller 1 f: the frequency $B_m$: a maximum magnetic flux density

ρ: the resistivity $k_e$: a proportional constant

The iron loss is proportional to the square of the thickness t, whereby a reduction in the thickness of the conductive layer 1*a* of the fixing roller 1 leads to a reduction in the iron loss that is proportional to the square of the thickness t. As indicated by the expression (11-1), the heat generation amount $P_e$ is proportional to the square of the "$B_m$: the maximum magnetic flux density within the material", whereby it is desirable to select a ferromagnetic material such as iron, cobalt, nickel, and an alloy thereof as the material of the conductive layer 1. On the other hand, use of a weakly magnetic material or a diamagnetic material results in a reduction in heat generation efficiency. Further, the heat generation amount $P_e$ is also proportional to the square of the thickness t, whereby reducing the thickness to 200 μm or thinner results in a reduction in the heat generation efficiency. There is such a problem that a material having a high resistivity p is also disadvantageous. Therefore, it is difficult to realize the design according to the table 6, which is provided as the specific examples of the numerical values that satisfy "1-8. CONDITION REQUIRED FOR CIRCUMFERENTIAL RESISTANCE OF SLEEVE". Then, because this configuration corresponds to the mechanism that generates heat by the skin current, the calculation of the circumferential resistance described in "1-6. METHOD FOR CALCULATING POWER ACCORDING TO TRANSFORMER MODEL" and illustrated in FIG. 8 cannot be applied thereto. This is because the current does not flow through the entire sleeve material but is concentrated in around the skin portion of the material. Therefore, the resistance value tends to become significantly larger, and it is easy to reduce the number of turns of the coil 6. On the other hand, the thickness of the sleeve 1 cannot be reduced.

Figure 13C:
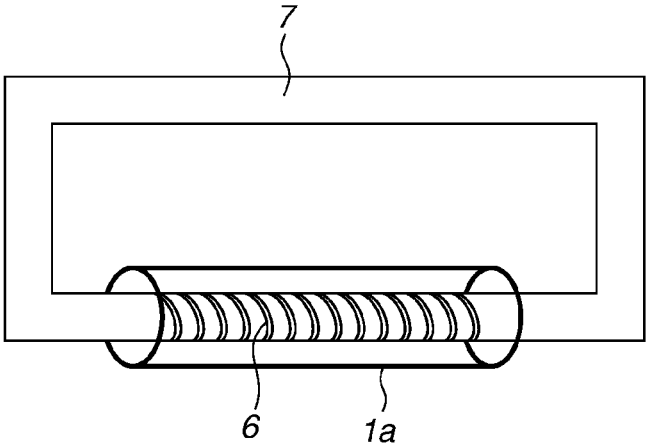

2-2. Guideline for Designing State in which more Perpendicular Components of Lines of Magnetic Force Pass Through 2-2-1. Relationship between Rate of Magnetic Flux Passing through Outside Conductive Layer and Power Conversion Efficiency The magnetic core 7 illustrated in FIG. 13A is shaped so as to have ends without forming a loop. In a fixing apparatus configured in such a manner that the magnetic core 7 forms a loop outside the conductive layer 1*a* as illustrated in FIG. 13C, lines of magnetic force exit from the inside to the outside of the conductive layer 1*a* and return to the inside of the conductive layer 1*a* by being guided by the magnetic core 7. However, if the magnetic core 7 is configured so as not to form a loop outside the fixing sleeve 1 (the conductive layer 1*a*), like the present exemplary embodiment, there is nothing to guide the lines of magnetic force that exit from an end of the magnetic core 7. Therefore, there is a possibility that a path of the lines of magnetic force returning to the other end of the magnetic core 7 after exiting from one end of the magnetic core 7 (from N to S) may extend through both an external route passing through outside the conductive layer 1*a*, and an internal route passing through inside the conductive layer 1*a*. Hereinafter, the term "external route" will be used to refer to the route going from N to S of the magnetic core 7 while passing through outside the conductive layer 1*a*, and the term "internal route" will be used to refer to the route going from N to S of the magnetic core 7 while passing through inside the conductive layer 1*a*.

A rate of lines of magnetic force passing through the external route among these lines of magnetic force exiting from the one end of the magnetic core 7 is correlated to the power consumed by the heat generation of the conductive layer 1*a* in the power supplied to the coil 6 (power conversion efficiency), and is an important parameter. As the rate of the lines of magnetic force passing through the external route increases, a rate of the power consumed by the heat generation of the conductive layer 1*a* with respect to the power supplied to the coil 6 (the power conversion efficiency) increases. A principle of this reason is similar to such a principle that the power conversion efficiency increases, if a leakage flux is sufficiently little in the transformer, and the number of lines of magnetic force passing through the secondary winding of the transformer is equal to the number of lines of magnetic force passing through the primary winding of the transformer. In other words, in the present exemplary embodiment, as the number of lines of magnetic force passing through the external route gets closer to the number of lines of magnetic force passing through within the magnetic core 7, the power conversion efficiency increases, and the high-frequency current supplied to the coil 6 can be more efficiently used for electromagnetic induction as the circumferential current around the conductive layer 1*a*.

As understood from the above description, it is important to manage the rate of the lines of magnetic force passing through the external route to acquire the required power conversion efficiency for the fixing apparatus according to the present exemplary embodiment.

2-2-2. Index Indicating Rate of Magnetic Flux Passing through Outside Conductive Layer Therefore, the rate of the lines of magnetic force passing through the external route in the fixing apparatus is expressed with use of an index called a permeance, which indicates how easily a line of magnetic force can pass through. First, a common idea about a magnetic circuit will be described. A circuit of a magnetic path which a line of magnetic force passes through is referred to as a magnetic circuit, while a circuit of an electric current is referred to as an electric circuit. A magnetic flux in the magnetic circuit can be calculated corresponding to a calculation of the current in the electric circuit. Ohm's law regarding the electric circuit can be employed for the magnetic circuit. The following expression (501) can be established, assuming that Φ represents the magnetic flux corresponding to the current in the electric circuit, V represents a magnetomotive force corresponding to an electromotive force, and R represents a magnetic resistance corresponding to an electric resistance.

$$\Phi = V/R \tag{501}$$

However, the principle will be described here with use of a permeance P, which is an inverse of the magnetic resistance R, to facilitate better understanding of the principle. Use of the permeance P allows the above-described expression (501) to be expressed by the following expression (502).

$$\Phi = V \times P \tag{502}$$

Further, this permeance P can be expressed by the following expression (503), assuming that B represents a length of the magnetic path, S represents a cross-sectional area of the magnetic path, and μ represents a magnetic permeability of the magnetic path.

$$P = \mu \times S/B \tag{503}$$

The permeance P is proportional to the cross-sectional area S and the magnetic permeability μ, and is inversely proportional to the magnetic path length B.

FIG. 15A illustrates the conductive layer 1*a* containing therein the magnetic core 7 having a radius $a_1$ [m], the length B [m], and a relative magnetic permeability $\mu_1$ with the coil 6 wound around the magnetic core 7 by N turns [turns] in such a manner that the axis of the helix extends substantially in parallel with the generatrix direction of the conductive layer 1*a*. In the example illustrated in FIG. 15A, the conductive layer 1*a* is a conductive body having the length B [m], an inner diameter $a_2$ [m], an outer diameter $a_3$ [m], and a relative magnetic permeability $\mu_2$. A vacuum space inside and outside the conductive layer 1*a* has a magnetic permeability $\mu_0$ [H/m]. A magnetic flux $\phi_c(x)$ indicates a magnetic flux 8 that is produced per unit length of the magnetic core 7 when a current I [A] is supplied to the coil 6. FIG. 15B is a cross-sectional view perpendicular to the longitudinal direction of the magnetic core 7. Arrows illustrated in FIG. 15B indicate magnetic fluxes that pass through the body of the magnetic core 7, inside the conductive layer 1*a*, and outside the conductive layer 1*a* in parallel with the longitudinal direction of the magnetic core 7 when the current I is supplied to the coil 6. A magnetic flux $\phi_c(=\phi_c(x))$ passes through the body of the magnetic core 7. A magnetic flux $\phi_{a_in}$ passes through inside the conductive layer 1*a* (passes through a region between the conductive layer 1*a* and the magnetic core 7). A magnetic flux $\phi_s$ passes through the conductive layer 1*a* itself. A magnetic flux $\phi_{a_out}$ passes through outside the conductive layer 1*a*.

Figure 16:
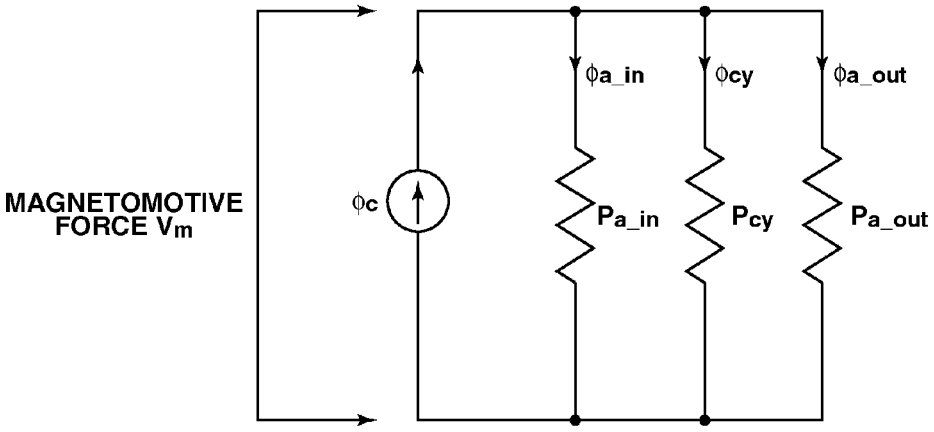
FIG. 16 illustrates a magnetic equivalent circuit.

FIG. 16A illustrates a magnetic equivalent circuit of a space containing the core 7, the coil 6, and the conductive layer 1*a* per unit length illustrated in FIG. 13A. Assume that $V_m$ represents the magnetomotive force produced by the magnetic flux $\phi_c$ passing through the magnetic core 7, $P_c$ represents a permeance of the magnetic core 7, $P_{a_in}$ represents a permeance inside the conductive layer 1*a*, $P_s$ represents a permeance of the body of the film conductive layer 1*a* itself, and $P_{a_out}$ represents a permeance outside the conductive layer 1*a*.

If the permeance $P_c$ is sufficiently large compared to the permeances $P_{a_in}$ and $P_s$, the magnetic flux passing through the body of the magnetic core 7 and exiting from the one end of the magnetic core 7 is considered to return to the other end of the magnetic core 7 by passing through any of the magnetic fluxes $\phi_{a_in}$, $\phi_s$, and $\phi_{a_out}$. Therefore, the following relational expression, an expression (504) is established.

$$\phi_c=\phi_{a_in}+\phi_s+\phi_{a_out} \tag{504}$$

Further, the magnetic fluxes $\phi_c$, $\phi_{a_in}$, $\phi_s$, and $\phi_{a_out}$ are expressed by the following expressions, expressions (505) to (508), respectively.

$$\phi_c=P_c\times V_m \tag{505}$$

$$\phi_s=P_s\times V_m \tag{506}$$

$$\phi_{a_in}=P_{a_in}\times V_m \tag{507}$$

$$\phi_{a_out}=P_{a_out}\cdot V_m \tag{508}$$

Therefore, if the expressions (505) to (508) are substituted into the expression (504), the permeance $P_{a_out}$ is expressed by the following expression, an expression (509).

$$P_c\times V_m=P_{a_in}\times V_m+P_s\times V_m+P_{a_out}\times V_m=(P_{a_in}+P_s+P_{a_out})\times V_m \therefore P_{a_out}=P_c-P_{a_in}-P_s \tag{509}$$

The permeances can be expressed as "magnetic permeability×cross-sectional area", and therefore can be expressed by the following expressions from the illustration of FIG. 15B, assuming that $S_c$ represents a cross-sectional area of the magnetic core 7, $S_{a_in}$ represents a cross-sectional area inside the conductive layer 1*a*, and $S_s$ represents a cross-sectional area of the conductive layer 1*a* itself. The unit is [H·m].

$$P_c=\mu_1\cdot S_c=\mu_1\cdot\pi(a_1)^2 \tag{510}$$

$$P_{a_in}=\mu_0\cdot S_{a_in}=\mu_0\cdot\pi\cdot((a_2)^2-(a_1)^2) \tag{511}$$

$$P_s=\mu_2\cdot S_s=\mu_2\cdot\pi\cdot((a_3)^2-(a_2)^2) \tag{512}$$

Substituting these expressions (510) to (512) into the expression (509) allows the permeance $P_{a_out}$ to be expressed by an expression (513).

$$P_{a_out}=P_c-P_{a_in}-P_s=\mu_1\cdot S_c-\mu_0\cdot S_{a_in}-\mu_2\cdot S_s=\pi\cdot\mu_1\cdot(a_1)^2-\pi\cdot\mu_0\cdot((a_2)^2-(a_1)^2)-\pi\cdot\mu_2\cdot((a_3)^2-(a_2)^2) \tag{513}$$

Use of the above-described expression (513) allows $P_{a_out}/P_c$, which is the rate of the lines of magnetic force passing through outside the conductive layer 1*a*, to be calculated.

The magnetic resistance R may be used instead of the permeance P. If the rate of the lines of magnetic force passing through outside the conductive layer 1*a* is discussed with use of the magnetic resistance R, the magnetic resistance R is simply an inverse of the permeance P, so that the magnetic resistance R per unit length can be expressed as "1/(magnetic permeability x cross-sectional area)". The unit is "1/(H·m)".

The following table 10A indicates a result of a specific calculation with use of parameters of the apparatus according to the present exemplary embodiment.

TABLE 10

| | UNIT | MAGNETIC CORE | FILM GUIDE | INSIDE CONDUCTIVE LAYER | CONDUCTIVE LAYER | OUTSIDE CONDUCTIVE LAYER |
|---|---|---|---|---|---|---|
| CROSS-SECTIONAL AREA | m^2 | 2.6E−05 | 1.0E−04 | 5.8E−04 | 3.3E−06 | |
| RELATIVE MAGNETIC PERMEABILITY | | 1800 | 1 | 1 | 1 | |
| MAGNETIC PERMEABILITY | H/m | 2.3E−3 | 1.3E−6 | 1.3E−6 | 1.3E−6 | |
| PERMEANCE PER UNIT LENGTH | H · m | 5.9E−08 | 1.3E−10 | 7.3E−10 | 4.1E−12 | 5.8E−08 |
| MAGNETIC RESISTANCE PER UNIT LENGTH | 1/(H · m) | 1.7E+07 | 8.0E+09 | 1.4E+09 | 2.4E+11 | 1.7E+07 |

TABLE 10-continued

| | UNIT | MAGNETIC CORE | FILM GUIDE | INSIDE CONDUCTIVE LAYER | CONDUCTIVE LAYER | OUTSIDE CONDUCTIVE LAYER |
|---|---|---|---|---|---|---|
| RATE OF MAGNETIC FLUX | % | 100.0% | 0.2% | 1.2% | 0.0% | 98.5% |

The magnetic core 7 is made from ferrite (having a relative magnetic permeability of 1800), and has the diameter of 14 [mm] and a cross-sectional area of $2.6\times10^{-5}$ [$m^2$]. A film guide is made from Polyphenylenesulfide (PPS) (having a relative magnetic permeability of 1.0), and has a cross-sectional area of $1.0\times10^{-4}$ [$m^2$]. The conductive layer 1*a* is made from stainless steel (having a relative magnetic permeability of 1.0), and has a diameter of 30 [mm], a thickness of 35 [μm], and a cross-sectional area of $3.3\times10^{-6}$ [$m^2$].

The cross-sectional area of the region between the conductive layer 1*a* and the magnetic core 7 is calculated by subtracting the cross-sectional area of the magnetic core 7 and the cross-sectional area of the film guide from a cross-sectional area of the hollow portion inside the conductive layer 1*a* having the diameter of 30 [mm]. The elastic layer 1*b* and the front layer 1*c* are disposed on an outer side with respect to the conductive layer 1*a*, and do not contribute to the heat generation. Therefore, they can be considered as an air layer outside the conductive layer 1*a* in the magnetic circuit model for calculating the permeance, and therefore do not have to be included in the calculation.

According to the table 10, the permeances $P_c$, $P_{a_in}$, and $P_s$ have the following values.

$$P_c=5.9\times10^{-8}\ [\mathrm{H\cdot m}]$$

$$P_{a_in}=1.3\times10^{-10}+7.3\times10^{-10}\ [\mathrm{H\cdot m}]$$

$$P_s=4.1\times10^{-12}\ [\mathrm{H\cdot m}]$$

The rate $P_{a_out}/P_c$ can be calculated with use of these values according to the following expression, an expression (514).

$$P_{a_out}/P_c=(P_c-P_{a_in}-P_s)/P_c=0.985(98.5\%) \tag{514}$$

The magnetic core 7 may be divided into a plurality of pieces in the longitudinal direction, and a space (a gap) may be provided between the respective divided magnetic cores In this case, if this space is filled with air, a material having a relative magnetic permeability that can be regarded as 1.0, or a material having a far lower relative magnetic permeability than the magnetic core 7, this leads to an increase in the magnetic resistance R of the entire magnetic core 7, resulting in significant deterioration of the function of guiding the lines of magnetic force.

The permeance of the magnetic core 7 divided in this manner should be calculated with use of a complicated calculation method. In the following description, for a configuration in which the magnetic core 7 is divided into a plurality of pieces, and the divided pieces are arranged at even intervals with a space or a sheet-like non-magnetic body sandwiched between adjacent pieces, a method for calculating the permeance of the entire magnetic core 7 will be described. In this case, a magnetic resistance per unit length should be acquired by calculating a magnetic resistance of the entire magnetic core 7 in the longitudinal direction, and then dividing the calculated magnetic resistance by the entire length. Then, a permeance per unit length should be acquired by calculating an inverse of the magnetic resistance per unit length.

Figure 17:
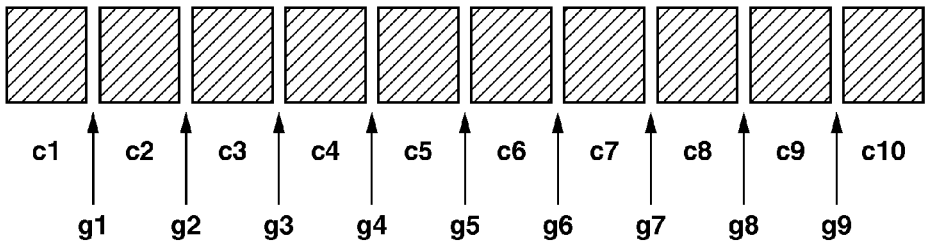
FIG. 17 illustrates a configuration of a magnetic core in a longitudinal direction.

First, FIG. 17 illustrates a configuration of the magnetic core 7 in the longitudinal direction. Magnetic cores c1 to c10 each have the cross-sectional area $S_c$, the magnetic permeability $\mu_c$, and a width $L_c$ per divided magnetic core. Gaps g1 to g9 each have a cross-sectional area $S_g$, a magnetic permeability $\mu_g$, and a width $L_g$ per gap. In this case, a magnetic resistance $R_{m_all}$ an of the entire magnetic core 7 in the longitudinal direction is expressed by the following expression, an expression (515).

$$R_{m_all}=(R_{m_c1}+R_{m_c2}+\ldots+R_{m_c10})+(R_{m_g1}+R_{m_g2}+\ldots+R_{m_g9}) \tag{515}$$

According to the present configuration, the magnetic cores c1 to c10 have the same shapes and are made from the same materials, and the gaps g1 to g9 have equal widths. Therefore, the magnetic resistances can be expressed by the following expressions (516) to (518), in which a sum of the magnetic resistances $R_{m_c}$ is indicated as $\Sigma R_{m_c}$ and a sum of the magnetic resistances $R_{m_g}$ is indicated as $\Sigma_{Rm_g}$.

$$R_{m_all}=(\Sigma R_{m_c})+(\Sigma R_{m_g}) \tag{516}$$

$$R_{m_c}=L_c/(\mu_c\cdot S_c) \tag{517}$$

$$R_{m_g}=L_g/(\mu_g\cdot S_g) \tag{518}$$

Substituting the expressions (517) and (518) into the expression (516) allows the magnetic resistance $R_{m_all}$ of the entire magnetic core 7 in the longitudinal direction to be expressed by the following expression, an expression (519).

$$R_{m_all}=(\Sigma R_{m_c})+(\Sigma R_{m_g})=(L_c/(\mu_c\cdot S_c))\times10+(L_g/(\mu_g\cdot S_g))\times9 \tag{519}$$

Then, the magnetic resistance $R_m$ per unit length is expressed by the following expression, an expression (520), in which a sum of the widths $L_c$ is indicated as $\Sigma L_c$ and a sum of the widths $L_g$ is indicated as $\Sigma L_g$.

$$R_m=R_{m_all}/(\Sigma L_c+\Sigma L_g)=R_{m_all}/(L_c\times10+L_g\times9) \tag{520}$$

From these expressions, the permeance $P_m$ per unit length can be acquired from the following expression (521).

$$P_m=1/R_m=(\Sigma L_c+\Sigma L_g)/R_{m_{all}}=(\Sigma L_c+\Sigma L_g)/[\{\Sigma L_c/(\mu_c\times S_c)\}+\{\Sigma L_g/(\mu_g\times S_g)\}] \tag{521}$$

An increase in the gap $L_g$ leads to an increase in the magnetic resistance of the magnetic core 7 (a reduction in the permeance). It is desirable to design the fixing apparatus in such a manner that the magnetic core 7 has a low magnetic resistance (a high permeance) in light of the heat generation principle when configuring the fixing apparatus according to the present exemplary embodiment, whereby it is undesirable to form a gap. However, the magnetic core 7 may be divided into a plurality of pieces with a gap formed therebetween to prevent the magnetic core 7 from being broken.

In this manner, the calculation described above has revealed that the rate of the lines of magnetic force passing through the external route can be also expressed with use of the permeance or the magnetic resistance.

<One Specific Example of Calculation of Magnetic Permeance>

A case example of the calculation for the configuration in which a space is provided between the divided cores with use of the above-described calculation method will be described. As illustrated in FIG. 17, each of all of magnetic cores c1 to c10 is ferrite having a relative magnetic permeability of 1800 and a saturation magnetic flux density of 500 mT, and is shaped into a columnar shape having a diameter of 11 mm and a length B of 20 mm. Ten magnetic cores are arranged at even intervals with a gap of G=0.5 mm formed between adjacent ones. A member made of a nickel (having a relative magnetic permeability of 600) having a diameter of 40 mm and a thickness of 0.5 mm is used as the fixing roller as the cylindrical member. The magnetic permeance per unit length can be calculated by the above-described method, and has a value as indicated in the following table 11.

TABLE 11

| CALCULATION EXAMPLE | SYMBOL | NUMERICAL VALUE | UNIT |
|---|---|---|---|
| LONGITUDINAL LENGTH OF MAGNETIC CORE | $L_c$ | 0.022 | m |
| MAGNETIC PERMEABILITY OF MAGNETIC CORE | $\mu_c$ | 2.3E−03 | H (A/m) |
| CROSS-SECTIONAL AREA OF MAGNETIC CORE | $S_c$ | 9.5E−05 | m^2 |
| MAGNETIC RESISTANCE OF MAGNETIC CORE | $R_{m_c}$ | 1.0E+05 | 1/A |
| LONGITUDINAL LENGTH OF GAP | $L_g$ | 0.0005 | m |
| MAGNETIC PERMEABILITY OF GAP | $\mu_g$ | 1.3E−06 | H (A/m) |
| CROSS-SECTIONAL AREA OF GAP | $S_g$ | 9.5E−05 | m^2 |
| MAGNETIC RESISTANCE OF GAP | $R_{m_g}$ | 4.2E+06 | 1/A |
| MAGNETIC RESISTANCE OF ENTIRE MAGNETIC CORE | $R_{m_all}$ | 4.3E+07 | 1/A |
| MAGNETIC RESISTANCE PER UNIT LENGTH | $R_m$ | 1.7E+08 | 1/(A · m) |
| PERMEANCE PER UNIT LENGTH | $P_m$ | 5.7E−09 | H/m |

The magnetic resistance of the gap has a value several times larger than the magnetic resistance of the magnetic core. From the above calculation, $5.7\times10^{-9}$ [H/m] is acquired as the magnetic permeance of the magnetic core per unit length. Then, calculating the ratio of the magnetic flux passing through each region based on this magnetic permeance produces a result as indicated in the following table 12.

TABLE 12

| ITEM | UNIT | MAGNETIC CORE | FILM GUIDE | INSIDE CONDUCTIVE LAYER | CONDUCTIVE LAYER |
|---|---|---|---|---|---|
| CROSS-SECTIONAL AREA | m^2 | 9.5E−05 | 1.0E−04 | 1.0E−03 | 6.2E−05 |
| RELATIVE MAGNETIC PERMEABILITY | | | 1 | 1 | 600 |
| MAGNETIC PERMEABILITY | H/m | | 1.3E−6 | 1.3E−6 | 7.5E−04 |
| PERMEANCE PER UNIT LENGTH | H · m | 5.7E−09 | 1.3E−10 | 1.3E−09 | 4.7E−08 |
| MAGNETIC RESISTANCE PER UNIT LENGTH | 1/(H · m) | 1.7E+08 | 8.0E+09 | 8.0E+08 | 2.1E+07 |

As the ratio of the magnetic permeances according to the present configuration, the magnetic permeance of the conductive layer is eight times larger than the magnetic permeance of the magnetic core. Therefore, the air outside the cylindrical member is not used as the magnetic path, whereby the rate of the magnetic flux outside the cylindrical member is 0%. Therefore, the magnetic flux does not pass through outside the cylindrical member, and is guided into the body of the heat generation rotatable member. In this configuration, the lines of magnetic force are shaped as illustrated in FIG. 13B.

2-2-3. Power Conversion Efficiency Required for Fixing Apparatus

Next, the power conversion efficiency required for the fixing apparatus according to the present exemplary embodiment will be described. For example, if the power conversion efficiency is 80%, power of remaining 20% is converted into heat energy and is consumed by the coil 6, the core 7, and the like other than the conductive layer 1*a*. If the power conversion efficiency is low, the members that should not generate heat, such as the magnetic core 7 and the coil 6, may generate heat to thereby raise the necessity of taking a measure for cooling down these members.

In the present exemplary embodiment, to cause the conductive layer 1*a* to generate heat, a high-frequency alternating current is supplied to the exciting coil 6 to produce an alternating magnetic field. This alternating magnetic field induces a current in the conductive layer 1*a*. As a physical model, this mechanism highly resembles the magnetic coupling of the transformer. Therefore, an equivalent circuit to the magnetic coupling of the transformer can be used to consider the power conversion efficiency. The exciting coil 6 and the conductive layer 1*a* are magnetically coupled to each other due to this alternating magnetic field, and the power supplied to the exciting coil 6 is transmitted to the conductive layer 1*a*. The "power conversion efficiency" described here means a ratio between the power supplied to the exciting coil 6, which is a magnetic field generation unit, and the power consumed by the conductive layer 1*a*. In the present exemplary embodiment, the power conversion efficiency means a ratio of the power supplied to a high-frequency converter 13 for the exciting coil 6 and the power consumed by the conductive layer 1*a*. This power conversion efficiency can be expressed by the following expression, an expression (522).

$$\text{POWER CONVERSION EFFICIENCY} = \text{POWER CONSUMED BY CONDUCTIVE LAYER} / \text{POWER SUPPLIED TO EXCITING COIL} \tag{522}$$

Power supplied to the exciting coil 6 and consumed by other members than the conductive layer 1*a* includes a loss due to a resistance of this exciting coil 6, a loss due to a magnetic characteristic of the material of the magnetic core 7, and the like.

Figure 18A:
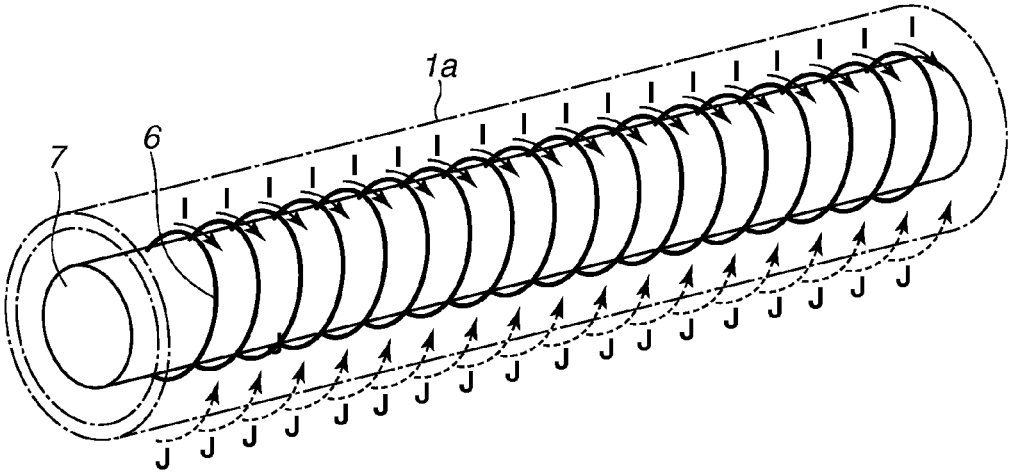
FIGS. 18A and 18*b* illustrate efficiency of the circuit.
Figure 18B:
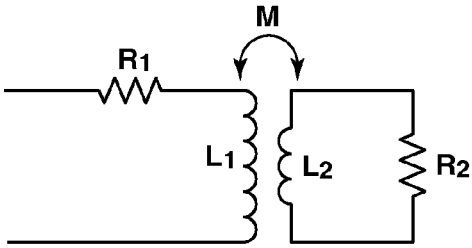

FIGS. 18A and 18B illustrate the efficiency of the circuit. FIG. 18A illustrates the conductive layer 1*a*, the magnetic core 7, and the exciting coil 6. FIG. 18B illustrates an equivalent circuit.

The equivalent circuit illustrated in FIG. 18B includes a loss $R_1$ due to the exciting coil 6 and the magnetic core 7, an inductance $L_1$ of the exciting coil 6 wound around the magnetic core 7, a mutual inductance M of the winding and the conductive layer 1*a*, an inductance $L_2$ of the conductive layer 1*a*, and a resistance $R_2$ of the conductive layer 1*a*. FIG. 19A illustrates an equivalent circuit when the conductive layer 1*a* is not mounted. Measuring the series equivalent resistance $R_1$ from both ends of the exciting coil 6 and the equivalent inductance $L_1$ with use of an apparatus such as an impedance analyzer and an LCR meter allows an impedance $Z_A$ as viewed from the both ends of the exciting coil 6 to be expressed by an expression (523).

$$Z_A = R_1 + j\omega L_1 \tag{523}$$

A current flowing through this circuit incurs a loss due to the resistance $R_1$. In other words, the resistance $R_1$ indicates the loss derived from the coil 6 and the magnetic core 7.

FIG. 19B illustrates an equivalent circuit when the conductive layer 1*a* is mounted. A relational expression (524) can be acquired by measuring a series equivalent resistance $R_x$ (525) and an inductance $L_x$ (526) when the conductive layer 1*a* is mounted, and performing equivalent conversion illustrated in FIG. 19C.

$$\begin{aligned} Z &= R_1 + j\omega(L_1 - M) + \frac{j\omega M(j\omega(L_2 - M) + R_2)}{j\omega M + j\omega(L_2 - M) + R_2} \\ &= R_1 + \frac{\omega^2 M^2 R_2}{R_2^2 + \omega^2 L_2^2} + j\omega(L_1 - M) + \frac{M \cdot R_2^2 + \omega^2 M L_2 (L_2 - M)}{R_2^2 + \omega^2 L_2^2} \end{aligned} \tag{524}$$

$$R_x = R_1 + \frac{\omega^2 M^2 R_2}{R_2^2 + \omega^2 L_2^2} \tag{525}$$

$$L_x = \omega(L_1 - M) + \frac{M \cdot R_2^2 + \omega^2 M L_2 (L_2 - M)}{R_2^2 + \omega^2 L_2^2} \tag{526}$$

In these expressions, M represents the mutual inductance of the exciting coil 6 and the conductive layer 1*a*.

As illustrated in FIG. 19C, an expression (527) is established, assuming that $I_1$ represents a current flowing through the resistance $R_1$, and $I_2$ represents a current flowing through the resistance $R_2$.

$$j\omega M(I_1 - I_2) = (R_2 + j\omega(L_2 - M))I_2 \tag{527}$$

Further, an expression (528) can be acquired from the expression (527).

$$I_1 = \frac{R_2 + j\omega L_2}{j\omega M} I_2 \tag{528}$$

The efficiency (power conversion efficiency) is expressed as (power consumed by the resistance $R_2$)/(power consumed by the resistance $R_1$+power consumed by the resistance $R_2$), and therefore can be expressed by an expression (529).

$$\begin{aligned} \text{POWER CONVERSION EFFICIENCY} &= \frac{R_2 \times |I_2^2|}{R_1 \times |I_1^2| + R_2 \times |I_2^2|} \\ &= \frac{\omega^2 M^2 R_2}{\omega^2 L_2^2 R_1 + R_1 R_2^2 + \omega^2 M^2 R_2} \\ &= \frac{R_X - R_1}{R_X} \end{aligned} \tag{529}$$

The power conversion efficiency, which indicates how much power is consumed by the conducive layer 1*a* with respect to the power supplied to the exciting coil 6, can be acquired by measuring the series equivalent resistance $R_1$ before the conductive layer 1*a* is mounted and the series equivalent resistance $R_x$ after the conductive layer 1*a* is mounted. In the present exemplary embodiment, Impedance Analyzer 429A manufactured by Agilent Technologies, Inc. was used to measure the power conversion efficiency. First, the series equivalent resistance $R_1$ from the both ends of the winding was measured without the fixing film mounted. Next, the series equivalent resistance $R_x$ from the both ends of the winding was measured with the magnetic core 7 inserted in the fixing film. The measurement result was $R_1$=103 mΩ and $R_x$=2.2Ω, so that 95.3% could be acquired as the power conversion efficiency at this time according to the expression (529). Hereinafter, the performance of a fixing apparatus will be evaluated with use of this power conversion efficiency.

Figure 20:
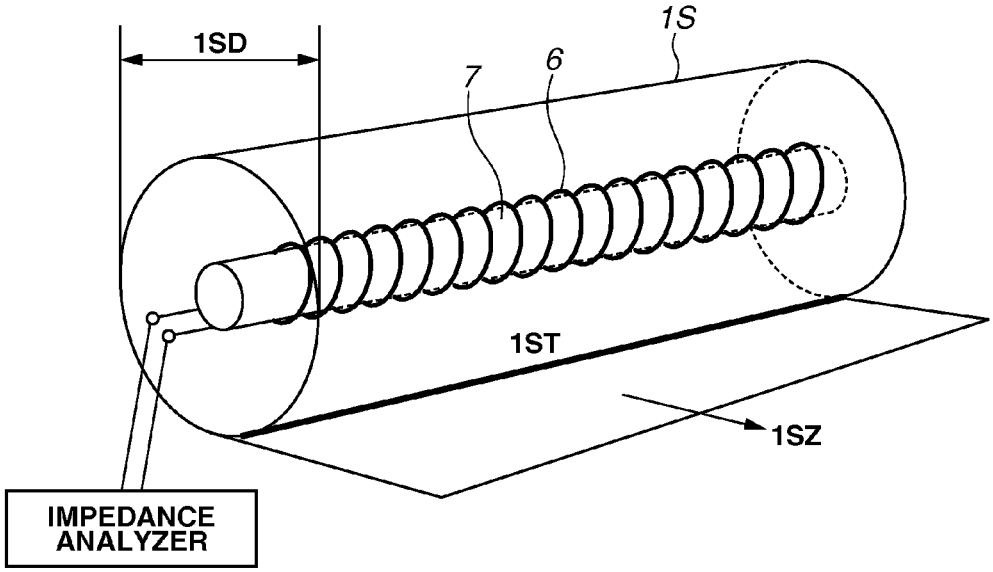
FIG. 20 illustrates a method for conducting an experiment for acquiring the power conversion efficiency.

Now, the power conversion efficiency required for the apparatus will be determined. The power conversion efficiency will be evaluated by acquiring the rate of the magnetic flux passing through the external route of the conductive layer 1*a*. FIG. 20 illustrates an experiment apparatus for use in an experiment of measuring the power conversion efficiency. A metallic sheet 1S is an aluminum sheet having a width of 230 mm, a length of 600 mm, and a thickness of 20 μm. This metallic sheet 1S is cylindrically rolled so as to surround the magnetic core 7 and the coil 6, and conductivity is established at a portion indicated by a thick line 1ST, by which this metallic sheet 1S is configured as the conductive layer. The magnetic core 7 is made from ferrite having a relative magnetic permeability of 1800 and a saturation magnetic flux density of 500 mT, and is shaped into a columnar shape having a cross-sectional area of 26 $mm^2$ and a length of 230 mm. The magnetic core 7 is disposed at a substantially central position of the cylinder formed from the aluminum sheet 1S with use of a not-illustrated fixing unit. The coil 6 is helically wound around the magnetic core 7 by twenty-five turns. A diameter 1SD of the conductive layer can be adjusted within a range of 18 to 191 mm by pulling an edge of the metallic sheet 1S in a direction indicated by an arrow 1SZ.

Figure 21:
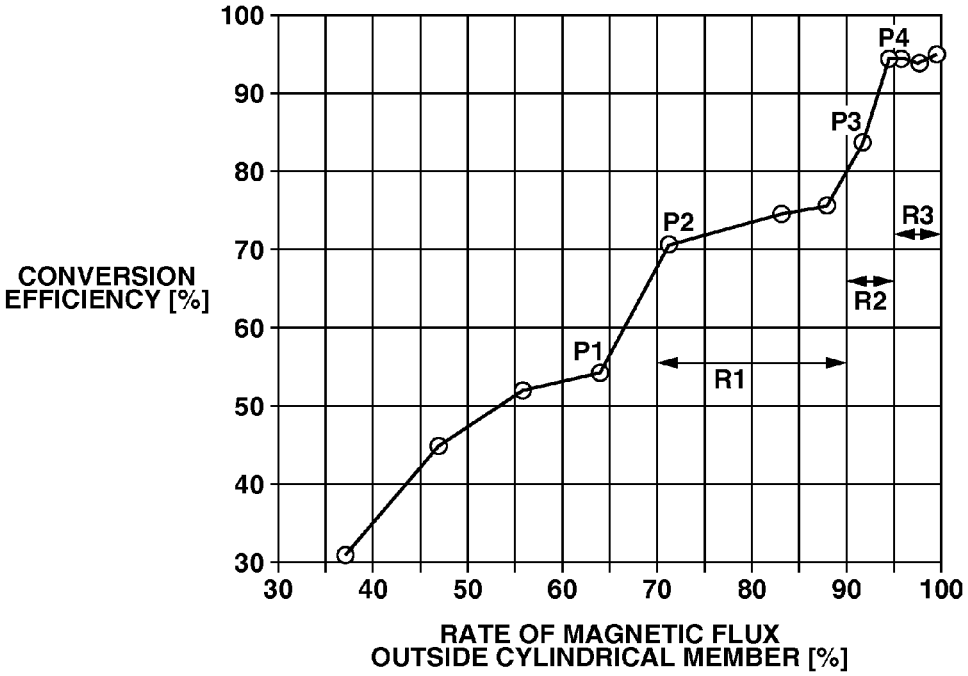
FIG. 21 is a graph illustrating the conversion efficiency.

FIG. 21 is a graph in which the rate [%] of the magnetic flux passing through the external route of the conductive layer is set to a horizontal axis, and the power conversion efficiency with a frequency of 21 kHz is set to a vertical axis.

The power conversion efficiency drastically increases after a plotted point P1 in the graph of FIG. 21 to then exceed 70%, and is maintained at 70% or higher in a range R1 indicated by an arrow. The power conversion efficiency drastically increases again at around a plotted point P3, and is maintained at 80% or higher in a range R2. The power conversion efficiency is stabilized at a high value of 94% or higher in a range R3 after a plotted point P4. A start of this drastic increase in the power conversion efficiency is due to a start of an efficient flow of the circumferential current around the conductive layer.

The following table 13 indicates a result of an experiment in which configurations corresponding to the plotted points P1 to P4 illustrated in FIG. 21 were actually designed as fixing apparatuses, and were evaluated.

TABLE 13

| NUMBER | REGION | DIAMETER OF CONDUCTIVE LAYER [mm] | RATE OF MAGNETIC FLUX PASSING THROUGH OUTSIDE CONDUCTIVE LAYER | CONVERSION EFFICIENCY [%] | EVALUATION RESULT (PROVIDED THAT FIXING APPARATUS IS HIGH-SPEC) |
|---|---|---|---|---|---|
| P1 | — | 143.2 | 64.0 | 54.4 | POWER MAY BE INSUFFICIENT |
| P2 | R1 | 127.3 | 71.2 | 70.8 | PROVISION OF COOLING UNIT IS DESIRABLE |
| P3 | R2 | 63.7 | 91.7 | 83.9 | OPTIMIZATION OF THERMALLY-RESISTANT DESIGN IS DESIRABLE |
| P4 | R3 | 47.7 | 94.7 | 94.7 | OPTIMUM CONFIGURATION FOR FLEXIBLE FILM |

<Fixing Apparatus P1>

According to this configuration, the magnetic core 7 had a cross-sectional area of 26.5 $mm^2$ (5.75 mm×4.5 mm). The conductive layer had a diameter of 143. 2 mm. The rate of the magnetic flux passing through the external route was 64%. The power conversion efficiency of this apparatus was measured by the impedance analyzer, and the result was 54.4%. The power conversion efficiency is a parameter that indicates the power having contributed to the heat generation of the conductive layer with respect to the power supplied to the fixing apparatus. Therefore, even if the fixing apparatus P1 is designed as a fixing apparatus capable of outputting 1000 W at most, approximately 450 W becomes a loss, and this loss is turned into heat generation of the coil 6 and the magnetic core 7.

According to this configuration, when the apparatus is powered on, a temperature of the coil 6 may exceed 200° C. only by supplying 1000 W for several seconds. The loss of 45% makes it difficult to maintain temperatures of the members such as the exciting coil 6 under upper temperature limits, in consideration of the facts that an upper limit temperature of an insulating body of the coil 6 is in the high 200° C., and a Curie point of the magnetic core 7 made from ferrite is normally approximately 200° C. to 250° C. Further, if a temperature of the magnetic core 7 exceeds the Curie point, the inductance of the coil 6 drastically decreases, leading to a load change.

Since approximately 45% of the power supplied to the fixing apparatus P1 is not used for the heat generation of the conductive layer, power of approximately 1636 W should be supplied to realize supply of power of 900 W (assuming that 90% of 1000 W should be satisfied) to the conductive layer. This means a power source consuming 16.36 A when 100 V is input. This may exceed an allowable current that can be supplied from an attachment plug for the commercial alternating current. Therefore, the fixing apparatus P1 corresponding to the power conversion efficiency of 54.4% may lead to insufficiency of the power supplied to the fixing apparatus P1.

<Fixing Apparatus P2>

According to this configuration, the magnetic core 7 had an equal cross-sectional area to the fixing apparatus P1. The conductive layer had a diameter of 127.3 mm. The rate of the magnetic flux passing through the external route was 71.2%. The power conversion efficiency of this apparatus was measured by the impedance analyzer, and the result was 70.8%. Temperature increases of the coil 6 and the core 7 may become a problem depending on the specification of the fixing apparatus P2. If the fixing apparatus P2 according to the present configuration is configured as a high-spec fixing apparatus capable of performing a printing operation corresponding to 60 pages per minute, the conductive layer rotates at a speed of 330 mm/sec, and a temperature of the conductive layer should be maintained at 180° C. Maintaining the temperature of the conductive layer at 180° C. may lead to exceedance of the temperature of the magnetic core 7 over 240° C. in twenty seconds. Since the Curie point of the ferrite used as the magnetic core 7 is normally approximately 200° C. to 250° C., the ferrite may exceed the Curie point, so that the magnetic permeability of the magnetic core 7 may drastically decrease, which may make it impossible for the magnetic core 7 to appropriately guide the lines of magnetic force. As a result, it may become difficult to induce the circumferential current to allow the conductive layer to generate heat.

Therefore, if the fixing apparatus having the rate of the magnetic flux passing through the external route within the range R1 is configured as the above-described high-spec fixing apparatus, it is desirable to provide a cooling unit for reducing the temperature of the ferrite core. An air-cooling fan, a water-cooling unit, a heat sink, a radiating fin, a heat pipe, a Peltier device, or the like can be used as the cooling unit. It is apparent that the cooling unit is unnecessary if the present configuration does not have to be so much high-spec.

<Fixing Apparatus P3>

According to this configuration, the magnetic core 7 had an equal cross-sectional area to that of the fixing apparatus P1. The conductive layer had a diameter of 63.7 mm. The power conversion efficiency of this apparatus was measured by the impedance analyzer, and the result was 83.9%. Although a heat amount is invariably generated at the magnetic core 7, the coil 6, and the like, this heat generation does not reach a level that necessitates the cooling unit. If the fixing apparatus P3 according to the present configuration is configured as the high-spec fixing apparatus capable of performing the printing operation corresponding to 60 pages per minute, the conductive layer rotates at the speed of 330 mm/sec, and the surface temperature of the conductive layer should be maintained at 180° C. However, the temperature of the magnetic core 7 (ferrite) does not increase to 220° C. or higher. Therefore, if the fixing apparatus P3 according to the present configuration is configured as the above-described high-spec fixing apparatus, it is desirable to use ferrite having a Curie point of 220° C. or higher.

As understood from the above description, if the fixing apparatus having the rate of the magnetic flux passing through the external route within the range R2 is configured as the high-spec fixing apparatus, it is desirable to optimize a thermally-resistant design of ferrite and the like. On the other hand, such a thermally-resistant design is unnecessary if the fixing apparatus does not have to be high-spec.

<Fixing Apparatus P4>

According to this configuration, the magnetic core 7 had an equal cross-sectional area to that of the fixing apparatus P1. The cylindrical member had a diameter of 47.7 mm. The power conversion efficiency of this apparatus was measured by the impedance analyzer, and the result was 94.7%. Even if the fixing apparatus P4 according to the present configuration is configured as the high-spec fixing apparatus capable of performing the printing operation corresponding to 60 pages per minute (the conductive layer rotates at the speed of 330 mm/sec) so that the surface temperature of the conductive layer should be maintained at 180° C., the temperatures of the exciting coil 6, the core 7, and the like do not reach 180° C. or higher. Therefore, this configuration does not require the cooling unit for cooling down the magnetic core 7, the coil 6, and the like, and the special thermally-resistant design.

As understood from the above description, if the fixing apparatus has the rate of the magnetic flux passing through the external route within the range R3, which is 94.7% or higher, the power conversion efficiency reaches 94.7% or higher and therefore is sufficiently high. Accordingly, even if this configuration is used as a further high-spec fixing apparatus, the cooling unit is unnecessary.

Further, within the range R3 where the power conversion efficiency is stabilized at a high value, even when a slight change occurs in an amount of the magnetic flux passing through inside the conductive layer per unit time due to a change in the positional relationship between the conductive layer and the magnetic core 7, the power conversion efficiency changes only by a small amount, so that the conductive layer can generate heat by a stabilized quantity. A huge merit is brought out by using this region R3 where the power conversion efficiency is stabilized at a high value for a fixing apparatus prone to a change in the distance between the conductive layer and the magnetic core 7, like a flexible film.

From the above description, it can be understood that the fixing apparatus according to the present exemplary embodiment should have 72% or higher as the rate of the magnetic flux passing through the external route to at least satisfy the required power conversion efficiency (the table 13 indicates 71.2%, but this is rounded to 72% in consideration of a measurement error and the like).

2-2-4. Relational Expression among Permeances or Magnetic Resistances that Apparatus should Satisfy Having 72% or higher as the rate of the magnetic flux passing through the external route of the conductive layer is equivalent to a sum of the permeance of the conductive layer and the permeance inside the conductive layer (the region between the conductive layer and the magnetic core 7) being 28% or lower of the permeance of the magnetic core 7. Therefore, one of characteristic features of the present exemplary embodiment is satisfaction of the following expression (530), assuming that $P_c$ represents the permeance of the magnetic core 7, $P_a$ represents the permeance inside the conductive layer 1*a*, and $P_s$ represents the permeance of the conductive layer 1*a*.

$$0.28 \times P_c \geq P_s + P_a \quad (530)$$

Further, if the relational expression among the permeances is expressed with the permeances replaced with the magnetic resistances, this expression is converted into the following expression, an expression (531).

$$0.28 \times P_c \geq P_s + P_a \quad (531)$$

$$0.28 \times \frac{1}{R_c} \geq \frac{1}{R_s} + \frac{1}{R_a}$$

$$0.28 \times \frac{1}{R_c} \geq \frac{1}{R_{sa}}$$

$$0.28 \times R_{sa} \geq R_c$$

Then, a combined magnetic resistance $R_{sa}$, which is a combination of the resistances $R_s$ and $R_a$, is calculated according to the following expression, an expression (532).

$$\frac{1}{R_{sa}} = \frac{1}{R_s} + \frac{1}{R_a} \quad (532)$$

$$R_{sa} = \frac{R_a \times R_s}{R_a + R_s}$$

$R_c$: the magnetic resistance of the magnetic core 7

$R_s$: the magnetic resistance of the conductive layer 1*a*

$R_a$: the magnetic resistance of the region between the conductive layer 1*a* and the magnetic core 7

$R_{sa}$: the combined magnetic resistance of the magnetic resistances $R_s$ and $R_a$ It is desirable that the above-described relational expression among the permeances or the magnetic resistances is satisfied over a whole extent of a maximum region of the fixing apparatus which the recording material is conveyed through (a maximum region which the image passes through), in cross-section perpendicular to the generatrix direction of the cylindrical rotatable member. Similarly, the fixing apparatus within the range R2 according to the present exemplary embodiment has 92% or higher as the rate of the magnetic flux passing through the external route of the conductive layer (the numerical value indicated in the table 13 is 91.7%, but this is rounded to 92% in consideration of a measurement error and the like). Having 92% or higher as the rate of the magnetic flux passing through the external route of the conductive layer is equivalent to the sum of the permeance of the conductive layer and the permeance inside the conductive layer (the region between the conductive layer and the magnetic core 7) being 8% or lower of the permeance of the magnetic core 7. Therefore, the following expression, an expression (533) is acquired as a relational expression among the permeances.

$$0.08 \times P_c \geq P_s + P_a \quad (533)$$

The following expression (534) is acquired by converting the above-described relational expression among the permeances into a relational expression among the magnetic resistances.

$$0.08 \times P_c \geq P_s + P_a$$

$$0.08 \times R_{sa} \geq R_c \quad (534)$$

Further, the fixing apparatus within the range R3 according to the present exemplary embodiment has 95% or higher as the rate of the magnetic flux passing through the external route of the conductive layer (the table 13 indicates 94.7%, but this is rounded to 95% in consideration of a measurement error and the like).

Having 95% or higher as the rate of the magnetic flux passing through the external route of the conductive layer is equivalent to the sum of the permeance of the conductive layer and the permeance inside the conductive layer (the region between the conductive layer and the magnetic core 7) being 5% or lower of the permeance of the magnetic core 7.

Therefore, the following expression (535) is acquired as a relational expression among the permeances.

$$0.05 \times P_c \geq P_s + P_a \quad (535)$$

The following expression, an expression (536) is acquired by converting this relational expression (535) among the permeances into a relational expression among the magnetic resistances.

$$0.05 \times P_c \geq P_s + P_a$$

$$0.05 \times R_{sa} \geq R_c \quad (536)$$

Figure 22:
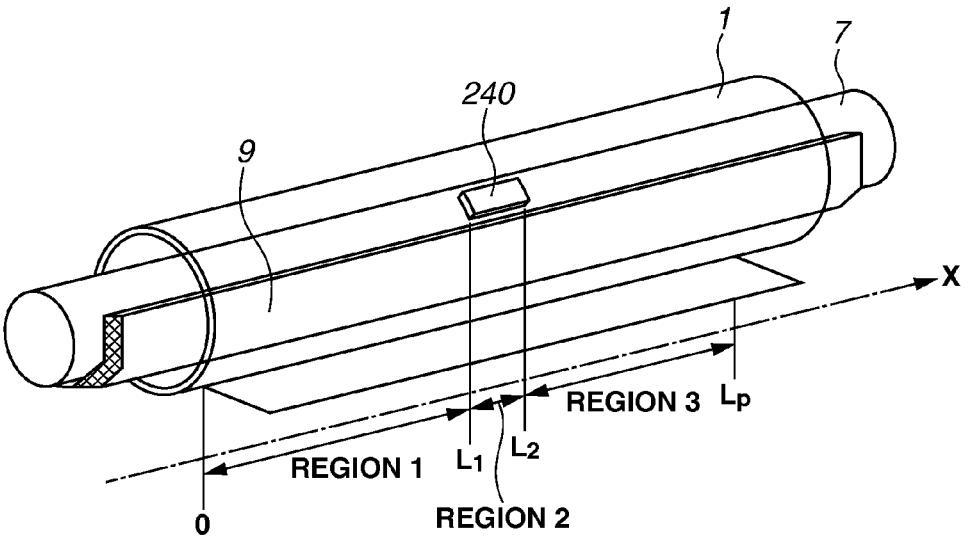
FIG. 22 illustrates a configuration of a fixing apparatus in the longitudinal direction.

The relational expressions among the permeances and the magnetic resistances have been described for the fixing apparatus in which the members and the like in a maximum image region of the fixing apparatus have an even cross-sectional configuration in the longitudinal direction. Next, a fixing apparatus in which the members included in the fixing apparatus have an uneven cross-sectional configuration in the longitudinal direction will be described. FIG. 22 illustrates a fixing apparatus including a temperature detection member 240 inside the conductive layer (in the region between the magnetic core 7 and the conductive layer). Other than that, the fixing apparatus illustrated in FIG. 22 is configured similarly to the second exemplary embodiment, and includes a film 1 having the conductive layer, the magnetic core 7, and a nip portion formation member (a film guide) 9.

Figure 23A:
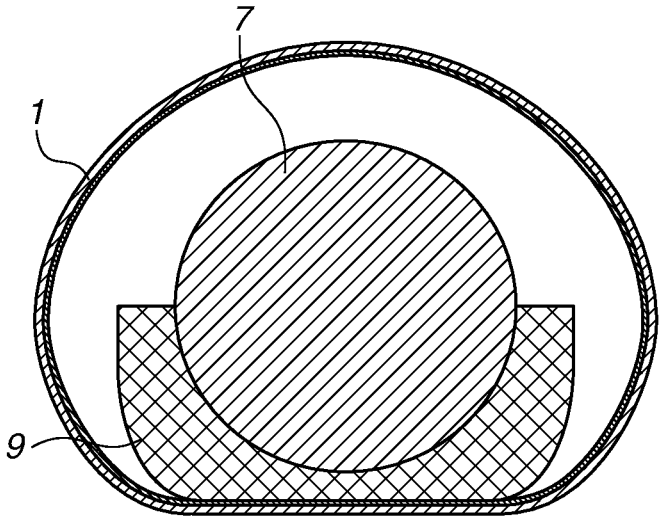
FIGS. 23A and 23B are cross-sectional views of the fixing apparatus.
Figure 23B:
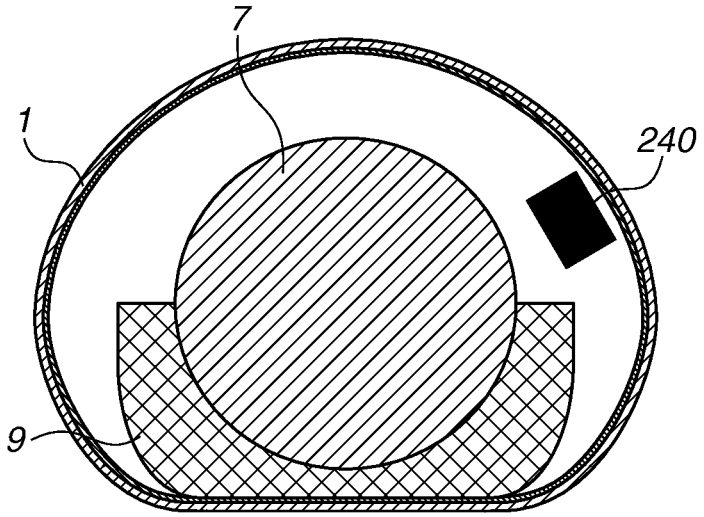

Assuming that an X axis direction corresponds to the longitudinal direction of the magnetic core 7, a maximum image formation region is a range of 0 to $L_p$ on the X axis. For example, for an image forming apparatus in which the maximum conveyance region for the recording material is 215.9 mm that is a letter (LTR) size, $L_p$ can be set to 215.9 mm. The temperature detection member 240 is made of a non-magnetic body having a relative magnetic permeability of 1, and has a cross-sectional area of 5 mm×5 mm in a direction perpendicular to the X axis, and a length of 10 mm in a direction in parallel with the X axis. The temperature detection member 240 is disposed at a position from $L_1$ (102.95 mm) to $L_2$ (112.95 mm) on the X axis. A region from 0 to $L_1$ as X coordinates is referred to as a region 1. A region from $L_1$ to $L_2$, where the temperature detection member 240 exists, is referred to as a region 2. A region from $L_2$ to $L_p$ is referred to as a region 3. FIG. 23A illustrates a cross-sectional configuration in the region 1, and FIG. 23B illustrates a cross-sectional configuration in the region 2. As illustrated in FIG. 23B, the temperature detection member 240 is contained in the film 1, and therefore is included in the magnetic resistance calculation. The following procedure is performed to strictly calculate the magnetic resistance. A "magnetic resistance per unit length" is calculated separately for each of the regions 1, 2, and 3. An integration calculation is performed according to a length of each region. Then, a combined magnetic resistance is calculated by adding up them. First, the following table 14 indicates the magnetic resistances of the respective members per unit length in the region 1 or 3.

TABLE 14

| ITEM | UNIT | MAGNETIC CORE | FILM GUIDE | INSIDE CONDUCTIVE LAYER | CONDUCTIVE LAYER |
|---|---|---|---|---|---|
| CROSS-SECTIONAL AREA | m^2 | 1.5E−04 | 1.0E−04 | 2.0E−04 | 1.5E−06 |
| RELATIVE MAGNETIC PERMEABILITY | | 1800 | 1 | 1 | 1 |
| MAGNETIC PERMEABILITY | H/m | 2.3E−03 | 1.3E−06 | 1.3E−06 | 1.3E−06 |
| PERMEANCE PER UNIT LENGTH | H · m | 3.5E−07 | 1.3E−10 | 2.5E−10 | 1.9E−12 |
| MAGNETIC RESISTANCE PER UNIT LENGTH | 1/(H · m) | 2.9E+06 | 8.0E+09 | 4.0E+09 | 5.3E+11 |

A magnetic resistance $r_{c1}$ of the magnetic core 7 per unit length in the region 1 has the following value.

$$r_{c1}=2.9\times10^{6}\ [1/(\mathrm{H\cdot m})]$$

A magnetic resistance $r_a$ of the region between the conductive layer and the magnetic core 7 per unit length is a combined magnetic resistance that is a combination of a magnetic resistance $r_f$ of the film guide per unit length, and a magnetic resistance $r_{air}$ inside the conductive layer per unit length. Therefore, the magnetic resistance $r_a$ can be calculated with use of the following expression, an expression (537).

$$\frac{1}{r_a}=\frac{1}{r_f}+\frac{1}{r_{air}} \tag{537}$$

As a result of the calculation, a magnetic resistance $r_{a1}$ in the region 1 and a magnetic resistance $r_{s1}$ in the region 1 have the following values.

$$r_{a1}=2.7\times10^{9}\ [1/(\mathrm{H\cdot m})]$$

$$r_{s1}=5.3\times10^{11}\ [1/(\mathrm{H\cdot m})]$$

Further, the region 3 is configured similarly to the region 1, whereby the respective magnetic resistances therein have the following values.

$$r_{c3}=2.9\times10^{6}\ [1/(\mathrm{H\cdot m})]$$

$$r_{a3}=2.7\times10^{9}\ [1/(\mathrm{H\cdot m})]$$

$$r_{s3}=5.3\times10^{11}\ [1/(\mathrm{H\cdot m})]$$

Next, the following table 15 indicates the magnetic resistances of the respective members per unit length in the region 2.

TABLE 15

| ITEM | UNIT | MAGNETIC CORE c | FILM GUIDE | THERMISTOR | INSIDE CONDUCTIVE LAYER | CONDUCTIVE LAYER |
|---|---|---|---|---|---|---|
| CROSS-SECTIONAL AREA | m^2 | 1.5E−04 | 1.0E−04 | 2.5E−05 | 1.72E−04 | 1.5E−06 |
| RELATIVE MAGNETIC PERMEABILITY | | 1800 | 1 | 1 | 1 | 1 |
| MAGNETIC PERMEABILITY | H/m | 2.3E−03 | 1.3E−06 | 1.3E−06 | 1.3E−06 | 1.3E−06 |
| PERMEANCE PER UNIT LENGTH | H · m | 3.5E−07 | 1.3E−10 | 3.1E−11 | 2.2E−10 | 1.9E−12 |
| MAGNETIC RESISTANCE PER UNIT LENGTH | 1/(H · m) | 2.9E+06 | 8.0E+09 | 3.2E+10 | 4.6E+09 | 5.3E+11 |

A magnetic resistance $r_{c2}$ of the magnetic core 7 per unit length in the region 2 has the following value.

$$r_{c2}=2.9\times10^{6}\ [1/(\mathrm{H\cdot m})]$$

The magnetic resistance $r_a$ of the region between the conductive layer and the magnetic core 7 per unit length is a combined magnetic resistance that is a combination of the magnetic resistance $r_f$ of the film guide per unit length, a magnetic resistance $r_t$ of the thermistor 240 per unit length, and the magnetic resistance $r_{air}$ of the air inside the conductive layer per unit length. Therefore, the magnetic resistance $r_a$ can be calculated with use of the following expression, an expression (538).

$$\frac{1}{r_a}=\frac{1}{r_t}+\frac{1}{r_f}+\frac{1}{r_{air}} \tag{538}$$

As a result of the calculation, a magnetic resistance $r_{a2}$ per unit length in the region 2 and a magnetic resistance $r_{a2}$ per unit length in the region 2 have the following values.

$$r_{a2}=2.7\times10^{9}\ [1/(\mathrm{H\cdot m})]$$

$$r_{s2}=5.3\times10^{11}\ [1/(\mathrm{H\cdot m})]$$

A calculation method for the region 3 is similar to the region 1, and therefore a description thereof is omitted here.

A reason why $r_{a1}=r_{a2}=r_{a3}$ is established regarding the magnetic resistance $r_a$ of the region between the conductive layer and the magnetic core 7 per unit length will be described now. In the magnetic resistance calculation for the region 2, the cross-sectional area of the thermistor 240 increases and the cross-sectional area of the air inside the conductive layer decreases. However, both of them have a relative magnetic permeability of 1, whereby the magnetic resistance does not change in the end regardless of whether the thermistor 240 exists. In other words, when only a non-magnetic body is disposed in the region between the conductive layer and the magnetic core 7, the calculation can maintain sufficient accuracy even when this non-magnetic body is handled in a similar manner to the air in the magnetic resistance calculation. This is because the non-magnetic body has a relative magnetic permeability almost close to 1. Conversely, if a magnetic body (nickel, iron, silicon steel, or the like) is disposed, the region where there is the magnetic body had better be calculated separately from other regions.

An integration of the magnetic resistance R [A/Wb(1/H)] as the combined magnetic resistance in the generatrix direction of the conductive layer can be calculated with respect to the magnetic resistances $r_1$, $r_2$, and $r_3$ [1/(H·m)] in the respective regions 1, 2, and 3, according to the following expression, an expression (539).

$$R=\int_0^{L_1} r_1 dl+\int_{L_1}^{L_2} r_2 dl+\int_{L_2}^{L_p} r_3 dl=r_1(L_1-0)+r_2(L_2-L_1)+r_3(L_p-L_2) \tag{539}$$

Therefore, the magnetic resistance $R_c$ [H] of the core 7 in a section from one end to the other end of the maximum conveyance region for the recording material can be calculated according to the following expression, an expression (540).

$$R_c=\int_0^{L_1} r_{c1} dl+\int_{L_1}^{L_2} r_{c2} dl+\int_{L_2}^{L_p} r_{c3} dl=r_{c1}(L_1-0)+r_{c2}(L_2-L_1)+r_{c3}(L_p-L_2) \tag{540}$$

Further, the combined magnetic resistance $R_a$ [H] of the region between the conductive layer and the magnetic core 7 in the section from the one end to the other end of the maximum conveyance region for the recording material can be calculated according to the following expression (541).

$$R_a=\int_0^{L_1} r_{a1} dl+\int_{L_1}^{L_2} r_{a2} dl+\int_{L_2}^{L_p} r_{a3} dl=r_{a1}(L_1-0)+r_{a2}(L_2-L_1)+r_{a3}(L_p-L_2) \tag{541}$$

The combined magnetic resistance $R_s$ [H] of the conductive layer in the section from the one end to the other end of the maximum conveyance region for the recording material can be calculated according to the following expression, an expression (542). The maximum conveyance region for the recording material may be the maximum region which the image passes through.

$$R_s=\int_0^{L_1} r_{s1} dl+\int_{L_1}^{L_2} r_{s2} dl+\int_{L_2}^{L_p} r_{s3} dl=r_{s1}(L_1-0)+r_{s2}(L_2-L_1)+r_{s3}(L_p-L_2) \tag{542}$$

The following table 16 indicates results of the above-described calculations performed for the respective regions.

TABLE 16

| | REGION 1 | REGION 2 | REGION 3 | COMBINED MAGNETIC RESISTANCE |
|---|---|---|---|---|
| START POINT OF INTEGRATION [mm] | 0 | 102.95 | 112.95 | |
| END POINT OF INTEGRATION [mm] | 102.95 | 112.95 | 215.9 | |
| DISTANCE [mm] | 102.95 | 10 | 102.95 | |
| PERMEANCE $p_c$ PER UNIT LENGTH [H · m] | 3.5E−07 | 3.5E−07 | 3.5E−07 | |
| MAGNETIC RESISTANCE $r_c$ PER UNIT LENGTH [1/(H · m)] | 2.9E+06 | 2.9E+06 | 2.9E+06 | |
| INTEGRATION OF MAGNETIC RESISTANCE $r_c$ [A/Wb(1/H)] | 3.0E+08 | 2.9E+07 | 3.0E+08 | 6.2E+08 |
| PERMEANCE $p_a$ PER UNIT LENGTH [H · m] | 3.7E−10 | 3.7E−10 | 3.7E−10 | |
| MAGNETIC RESISTANCE $r_a$ PER UNIT LENGTH [1/(H · m)] | 2.7E+09 | 2.7E+09 | 2.7E+09 | |
| INTEGRATION OF MAGNETIC RESISTANCE $r_a$ [A/Wb(1/H)] | 2.8E+11 | 2.7E+10 | 2.8E+11 | 5.8E+11 |
| PERMEANCE $p_s$ PER UNIT LENGTH [H · m] | 1.9E−12 | 1.9E−12 | 1.9E−12 | |
| MAGNETIC RESISTANCE $r_s$ PER UNIT LENGTH [1/(H · m)] | 5.3E+11 | 5.3E+11 | 5.3E+11 | |
| INTEGRATION OF MAGNETIC RESISTANCE $r_s$ [A/Wb(1/H)] | 5.4E+13 | 5.3E+12 | 5.4E+13 | 1.1E+14 |

According to the table 16 provided above, the magnetic resistances $R_c$, $R_a$, and $R_s$ have the following values.

$$R_c=6.2\times10^{8}\ [1/H]$$

$$R_a=5.8\times10^{11}\ [1/H]$$

$$R_s=1.1\times10^{14}\ [1/H]$$

The combined magnetic resistance $R_{sa}$ as the combination of the magnetic resistances $R_s$ and $R_a$ can be calculated according to the following expression, an expression (543).

$$\frac{1}{R_{sa}}=\frac{1}{R_s}+\frac{1}{R_a} \qquad (543)$$

$$R_{sa}=\frac{R_a\times R_s}{R_a+R_s}$$

From the above-described calculation, $R_{sa}=5.8\times10^{11}$ [1/H] is acquired as the combined magnetic resistance $R_{sa}$, and therefore the following expression, an expression (544) is satisfied.

$$0.28\times R_{sa}\geq Rc \qquad (544)$$

In this manner, for the fixing apparatus having an uneven cross-sectional shape in the generatrix direction of the conductive layer, the permeance or the magnetic resistance can be calculated by dividing the fixing apparatus into a plurality of regions in the generatrix direction of the conductive layer, calculating the permeance or the magnetic resistance for each of the regions, and lastly calculating the combined permeance or the combined magnetic resistance as a combination of them. However, if a target member is a non-magnetic body, the permeance or the magnetic resistance may be calculated while handling the non-magnetic body as air, since the magnetic permeability of the non-magnetic body is substantially equal to the magnetic permeability of air. Next, a member that should be included in the above-described calculation will be described. It is desirable to calculate the permeance or the magnetic resistance for a member located in the region between the conductive layer and the magnetic core 7 and having at least a part thereof located within the maximum conveyance region (0 to $L_p$) for the recording medium. Conversely, the permeance or the magnetic resistance does not have to be calculated for a member located outside the conductive layer. This is because the induced electromotive force is proportional to a temporal change in the magnetic flux perpendicularly penetrating through the circuit according to Faraday's law as described above, and is unrelated to the magnetic flux outside the conductive layer. Further, a member disposed outside the maximum conveyance region for the recording material in the generatrix direction of the conductive layer does not affect the heat generation of the conductive layer, and therefore does not have to be included in the calculation.

In this manner, the "guideline for designing the state in which more perpendicular components of lines of magnetic force pass through" has been described.

2-3. Result of Comparison

Compared to the configuration according to the first exemplary embodiment, the configuration according to the second exemplary embodiment has such a merit that this configuration can be constructed with a reduced number of components and allows the entire apparatus to be designed as a compact structure, because this configuration does not require formation of the closed magnetic path. Further, the configuration according to the second exemplary embodiment has such a merit that this configuration can reduce the loss due to the core, because the core can be designed so as to have a reduced volume.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-261520 filed Dec. 18, 2013, which is hereby incorporated by reference herein in its entirety.

What is claimed is:

1. An image heating apparatus configured to heat an image formed on a recording material, the image heating apparatus comprising:

a cylindrical rotatable member including a conductive layer;

a magnetic core provided in a hollow portion of the rotatable member;

a coil helically wound around an outer side of the magnetic core in the hollow portion of the rotatable member, a helical axis of the coil extending along a generatrix direction of the rotatable member; and an inverter configured to supply an alternating current to the coil, in which a frequency of the alternating current supplied from the inverter is within a range of 20.5 to 100 kHz, wherein the conductive layer generates heat by electromagnetic induction due to an alternating magnetic field produced from the alternating current supplied to the coil, wherein the coil is wound at an interval of 1 mm or longer, and wherein a magnetic resistance of the magnetic core is 28% or less of a combined magnetic resistance that is a combination of a magnetic resistance of the conductive layer and a magnetic resistance of a region between the conductive layer and the magnetic core, in a section from one end to the other end of a maximum region which the image passes through with respect to the generatrix direction of the rotatable member.

2. The image heating apparatus according to claim 1, wherein an induced current flows in a circumferential direction of the rotatable member, by which the conductive layer generates the heat, the induced current flowing in an entire circumference of the conductive layer.

3. The image heating apparatus according to claim 1, wherein the magnetic core is shaped not to form a loop outside the rotatable member.

4. The image heating apparatus according to claim 1, wherein magnetic fluxes, which generate according to the alternating magnetic field, pass through the magnetic core in a longitudinal direction of the rotatable member.

* * * * *